US009889543B2

(12) United States Patent
Roesch et al.

(10) Patent No.: US 9,889,543 B2
(45) Date of Patent: Feb. 13, 2018

(54) CLAMPING TOOL

(71) Applicant: BESSEY Tool GmbH & Co. KG, Bietigheim-Bissingen (DE)

(72) Inventors: Hans Roesch, Gemmrigheim (DE); Thomas Klein, Besigheim (DE); Gerhard Kloepfer, Pleidelsheim (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 0 days.

(21) Appl. No.: 14/875,807

(22) Filed: Oct. 6, 2015

(65) Prior Publication Data

US 2016/0184979 A1 Jun. 30, 2016

Related U.S. Application Data

(63) Continuation of application No. PCT/EP2014/058683, filed on Apr. 29, 2014.

(30) Foreign Application Priority Data

Apr. 30, 2013 (DE) ..... 10 2013 104 413

(51) Int. Cl.
*B25B 5/00* (2006.01)
*B25B 5/12* (2006.01)
(Continued)

(52) U.S. Cl.
CPC ..... *B25B 5/12* (2013.01); *B25B 5/006* (2013.01); *B25B 5/06* (2013.01); *B25B 7/123* (2013.01)

(58) Field of Classification Search
USPC ..... 269/228
See application file for complete search history.

(56) References Cited

U.S. PATENT DOCUMENTS 2,350,034 A 5/1944 Herrington
2,531,285 A 11/1950 Manspeaker
(Continued)

FOREIGN PATENT DOCUMENTS

CA 2739931 A1 * 4/2010
WO 2010/045504 4/2010

OTHER PUBLICATIONS

International Search Report for corresponding application PCT/EP2014/058683 dated Aug. 12, 2014, 3 pages.

*Primary Examiner* — George Nguyen
(74) *Attorney, Agent, or Firm* — Lipsitz & McAllister, LLC

(57) ABSTRACT

A clamping tool is provided which includes a base, a clamping arm articulated to the base for pivotal movement about a first pivot axis, a handle articulated to the clamping arm or base for pivotal movement about a second pivot axis, a bridge element articulated to the handle or the clamping arm for pivotal movement about a third pivot axis, a first wedge element having a first wedge surface, and a second wedge element having a second wedge surface facing towards the first wedge surface. In a first positional range of the handle, the wedge surfaces are spaced apart. In a second positional range of the handle, the second wedge surface is supported on the first wedge surface, displacement of the first wedge element driving a displacement of the second wedge element. The bridge element is articulated to the first wedge element for pivotal movement about a fourth pivot axis.

29 Claims, 24 Drawing Sheets

(51) Int. Cl.
*B25B 5/06* (2006.01)
*B25B 7/12* (2006.01)

(56) References Cited

U.S. PATENT DOCUMENTS

| | | | | |
|---|---|---|---|---|
| 2,751,801 | A | 6/1956 | Hostetter | |
| 2,920,518 | A * | 1/1960 | La Pointe | B25B 7/123 81/370 |
| 3,116,656 | A * | 1/1964 | Hostetter | B25B 7/123 81/379 |
| 3,446,102 | A | 5/1969 | Hallmark | |
| 3,600,986 | A | 8/1971 | Baldwin | |
| 3,964,738 | A * | 6/1976 | Owen | B25B 5/06 269/221 |
| 3,971,552 | A * | 7/1976 | Mayfield | B25B 5/06 269/228 |
| 4,407,493 | A | 10/1983 | Okolischan | |
| 4,747,588 | A * | 5/1988 | Dillhoff | B25B 5/12 269/258 |
| 6,113,085 | A * | 9/2000 | Lindenthal | B25B 5/102 269/170 |
| 6,591,719 | B1 | 7/2003 | Poole et al. | |
| 6,776,072 | B2 | 8/2004 | Poole et al. | |
| 7,007,937 | B2 | 3/2006 | Foshag et al. | |
| 8,104,754 | B1 | 1/2012 | Clark | |
| 8,613,433 | B2 | 12/2013 | Poole et al. | |
| 2010/0148414 | A1 | 6/2010 | Poole et al. | |
| 2010/0186558 | A1 * | 7/2010 | Hile | B25B 7/123 81/370 |
| 2011/0107880 | A1 * | 5/2011 | Stucky | B25B 7/123 81/370 |
| 2014/0265087 | A1 * | 9/2014 | Aguayo | B25B 5/003 269/9 |

* cited by examiner

CLAMPING TOOL

This application is a continuation of international application number PCT/EP2014/058683 filed on Apr. 29, 2014 and claims the benefit of German application No. 10 2013 104 413.1 filed on Apr. 30, 2013, which are incorporated herein by reference in their entirety and for all purposes.

BACKGROUND OF THE INVENTION

The invention relates to a clamping tool, comprising a base, a clamping arm articulated to the base for pivotal movement about a first pivot axis, a handle articulated to the clamping arm or the base for pivotal movement about a second pivot axis, a bridge element articulated to the handle or the clamping arm for pivotal movement about a third pivot axis, a first wedge element having a first wedge surface, said first wedge element being linearly guided on a guide, and a second wedge element having a second wedge surface facing towards the first wedge surface, said second wedge element being adapted to the first wedge element and being linearly guided, wherein in a first positional range of the handle, the first wedge surface and the second wedge surface are spaced apart from one another and wherein in a second positional range of the handle, the second wedge surface is supported on the first wedge surface and a displacement of the first wedge element drives a displacement of the second wedge element.

Toggle clamping tools are used for example to clamp workpieces in place on a machine table. The displacement capability of the first wedge element allows adjustment to accommodate different heights of workpieces to be clamped within a certain range.

U.S. Pat. No. 4,407,493 discloses a toggle clamp which is self-adjusting ("self-adjusting toggle clamp").

Further toggle clamps are known from US 2010/0148414 A1 or WO 2010/045504 A1.

U.S. Pat. No. 2,350,034 discloses a toggle clamp having a base and an L-shaped clamping arm made of a U-shaped strap having its free ends pivotally connected to the base. The connection is at a point where a pivot bearing passes laterally through the strap ends. Furthermore, there is provided a clamping element which is located at the other end of the clamping arm. A handle has one of its ends pivotally connected to a point located in the bend of the L of the clamping arm. A link has one end pivotally connected to the base and the other end pivotally connected to the handle at a point between the pivotal connection of the handle with the clamping arm and the pivotal connection between the link and the base. When the corresponding parts are in a clamping position, the pivotal connections between one end of the link and the base, the handle with the clamping arm, and the handle with the other end of the link are aligned in one line. The pivotal connection between the handle and the other end of the link is intermediate the other of the pivotal connections. The base has provided thereon means for limiting the movement of the link and the clamping arm.

Further clamping tools are disclosed in U.S. Pat. Nos. 3,116,656, 2,531,285, 3,600,986 and 2,751,801.

SUMMARY OF THE INVENTION

In accordance with an exemplary embodiment of the invention, there is provided a clamping tool which affords a wide range of variation with simplicity of construction.

In accordance with an exemplary embodiment of the invention, the bridge element is connected to the first wedge element and is articulated to the first wedge element for pivotal movement about a fourth pivot axis.

In the solution in accordance with the invention, the bridge element is permanently connected to the first wedge element by a joint connection for the articulating action. The number of components can thereby be kept low, and therefore the corresponding clamping tool is easy to manufacture. There results a wide range of variation for the clampability of workpieces in terms of workpiece height above a support upon which the clamping tool is set. This affords a simple way of adjusting a clamping force.

The clamping tool constructed in accordance with the invention, when configured as a toggle clamp, can be used for example as a machine clamp or as pliers, such as locking pliers.

In particular, the bridge element is of rigid configuration and is in particular formed in a one-piece configuration. This makes the clamping tool simple to manufacture.

For the same reason, it is advantageous for the bridge element to be of rigid configuration between a joint for articulation to the handle or to the clamping arm and a joint for articulation to the first wedge element. The bridge element then merely represents a fixed bridge element.

Advantageously, the first pivot axis, the second pivot axis, the third pivot axis and the fourth pivot axis are oriented parallel to one another. A clamping tool can thereby be realized in a simple manner.

It is particularly advantageous for an adjustment device to be provided which acts on the second wedge element and which provides a capability of adjusting a position of the second wedge element in which the first wedge element acts on the second wedge element for driving it. The adjustment device provides a capability of adjusting at what pivotal position of the handle the first wedge element starts driving the second wedge element. The locking force of the clamping tool for a workpiece is thereby capable of being adjusted.

It is particularly advantageous for the adjustment device to be arranged on the bridge element and, in particular, to be held on the bridge element. The bridge element then has the same pivot point as the bridge element. This results in a simple construction of the clamping tool. The adjustment device can be easily accessed by use of a tool, such as a screwdriver, or without the use of tools because there is enough space available for this action. It is easily implemented that a clamping force is capable of being adjusted in a defined manner over a large angular range for the clamping arm relative to a support, and in particular over the entire angular range. Once adjusted, the clamping force is at least approximately the same for different workpiece heights. The clamping tool is thereby easy to use.

In an exemplary embodiment, the adjustment device comprises an operative element located on the bridge element for pivotal movement about a fifth pivot axis. It is then possible for the locking force to be adjusted by a relative angular position of the operative element relative to the bridge element.

In particular, the fifth pivot axis is parallel to the fourth pivot axis. This makes for a simple construction.

In an advantageous embodiment, the operative element has located thereon an adjustment element by which an angular position of the operative element relative to the bridge element is capable of being fixably adjusted. In particular, the adjustment element is a spacer element which fixes a distance to the bridge element at or near an end of the operative element, thereby fixing the angular position of the operative element relative to the bridge element.

In an embodiment that is advantageous in terms of manufacturability, the adjustment element is a screw which is guided in a thread on the operative element and which is in particular supported at one end thereof on the bridge element. This gives simplicity of construction. Threadedly guiding the screw provides a simple way of fixably adjusting the relative position of the operative element relative to the bridge element.

Provision may be made for the operative element to be supported on the first wedge element in at least a portion of a range of pivotal motion of the operative element. This results in increased stability.

It is advantageous for the operative element to be of rounded configuration in an area in which it is capable of acting on the second wedge element. The rounding is defined. This provides an effective way of fixing the starting position of the second wedge element within a predetermined pivoting range and hence, in turn, of fixing the position at which the first wedge element can start driving the second wedge element. This in turn fixes the locking force. With appropriate configuration, an angle-independent clamping force can be at least approximately adjusted.

It is advantageous for a spring device to be provided which acts on the second wedge element, wherein a spring force of the spring device tends to urge the second wedge element in a direction towards the bridge element. The spring device then provides for the second wedge element to be able to be in contact against a contact surface of an adjustment device when the first wedge element does not yet contact the second wedge element.

In an embodiment, the guide is arranged on the base. This makes for a simple construction.

In an embodiment, the base has an underside which faces away from the clamping arm and the guide is spaced at a height distance from the underside of the base. An interspace is thereby formed between a plane on which the underside lies and the guide. This can be utilized, for example, to arrange the guide in a handle element which is capable of being grasped by an operator. For example, when the base is fixed via its underside to an application, then there exists an interspace between the application and the guide and hence the handle element. An operator can reach through this interspace and, for example, grasp the handle and the handle element with one hand.

In an exemplary embodiment, the clamping tool is capable of being fixed to an application via the underside of the base. This enables easy fixability.

It is particularly advantageous for the base to have a handle element arranged thereon. This allows an operator to grasp the handle element and the handle with one hand and, for example, clamp a workpiece by moving the handle in a direction towards the handle element. For example, the workpiece can then be clamped between the clamping arm and a support or between the clamping arm (first clamping arm) and a second clamping arm which is arranged on the base.

In an embodiment that is simple in structure, the handle element is rigidly connected to the base.

It is advantageous for the application if, in a starting position of the clamping tool, the handle and the handle element are oriented at least approximately parallel to one another. The starting position is in particular a clamping position. This provides an easy way of realizing for example a toggle clamp in the form of a horizontal clamp or in the form of locking pliers, wherein a workpiece is capable of being clamped by moving the handle in a direction towards the handle element.

In particular, it is advantageous for the guide to be arranged on the handle element. This makes for a compact construction of the clamping tool combined with ease of use.

In particular, the first wedge element and the second wedge element are then arranged on the handle element and capable of being linearly guided thereon. This results in a simple and compact construction with many capabilities of use.

It is further advantageous for the handle element of the base and the handle to be arranged oppositely to each other and to be capable of being grasped in common by the hand of an operator. This results in ease of use and, in particular, enables one-hand operation.

In an exemplary embodiment of a clamping tool in the form of a toggle clamp, the clamping arm is a first clamping arm and the base has arranged thereon a second clamping arm, wherein a workpiece is capable of being clamped between the first clamping arm and the second clamping arm. A toggle clamping tool that provides adjustable clamping force is thereby realized. Such a clamping tool may be used as locking pliers, for example.

In particular, the second clamping arm is then fixidly connected to the base. In this manner, corresponding pliers can be realized which are simple in structure.

In particular, the clamping tool, which is a toggle clamp, is then configured as pliers and/or locking pliers.

When the clamping tool is configured as pliers, it is advantageous for the clamping arm and/or a further clamping arm to have a first region, said first region having located thereon an angled second region, wherein the second region has arranged thereon a contact element for a workpiece. It is thereby possible to achieve a high clamping force for clamping a tool.

It is advantageous for the contact element to be pivotally or rotatably located on the second region. This allows for an alignment to be achieved in order, for example, to compensate for irregularities or to enable clamping of workpieces having non-parallel opposing surfaces.

In particular, the second region is oriented relative to the first region in an angular range between 70° and 110° and, preferably, the second region is oriented to the first region at at least approximately right angles. Pliers, such as locking pliers, can thereby be implemented in an advantageous manner.

For the same reason it is advantageous if, where a first clamping arm and a second clamping arm are present, the second region of the first clamping arm and the second region of the second clamping arm are aligned at least approximately in line with each other when the first clamping arm is in a starting position. This results in an effective clampability of a workpiece between corresponding contact elements of the first clamping arm and the second clamping arm.

A clamping tool constructed in accordance with the invention can be configured as a horizontal clamp in which clamping of a workpiece by the clamping arm is capable of being effected by pivoting the handle in a direction towards the base.

In particular, the clamping arm is then articulated to the base, the handle is articulated to the clamping arm and the bridge element is articulated to the handle.

It is advantageous for the bridge element to be oriented at least approximately parallel to the clamping arm when at a toggle lever dead centre. A horizontal clamp can thereby be implemented in a simple manner.

The following description of preferred embodiments serves in conjunction with the drawings to explain the invention in greater detail.

BRIEF DESCRIPTION OF THE DRAWINGS

FIGS. 1 to 6 are schematic representations of a first exemplary embodiment of a clamping tool constructed in accordance with the invention and configured in the form of a toggle clamp, wherein;

FIG. 1 is a schematic sectional view in a first position of the handle;

FIG. 2 is an enlarged view of the detail of FIG. 1;

FIG. 3 is the toggle clamp of FIG. 1, shown in a second position of the handle;

FIG. 4 is the detail of FIG. 3 on an enlarged scale;

FIG. 5 shows a locking position of the handle;

FIG. 6 is an enlarged view of the detail of FIG. 5;

FIGS. 7 to 12 illustrate a second exemplary embodiment of a clamping tool constructed in accordance with the invention and configured in the form of a toggle clamp, wherein FIG. 7 shows the toggle clamp in a first position;

FIG. 8 shows the detail of the marked area in FIG. 7 to an enlarged scale;

FIG. 9 is the toggle clamp of FIG. 7, shown in a second position of the handle;

FIG. 10 is the detail of the marked area in FIG. 9 on an enlarged scale;

FIG. 11 shows a locking position of the handle;

FIG. 12 is an enlarged view of the detail of the marked area in FIG. 11;

FIGS. 14 to 19 illustrate a third exemplary embodiment of a clamping tool constructed in accordance with the invention and configured in the form of a toggle clamp, wherein FIG. 14 is the toggle clamp in a first position of a handle;

FIG. 15 shows the detail of the marked area in FIG. 14 to an enlarged scale;

FIG. 16 shows a second position of the handle of the toggle clamp of FIG. 14;

FIG. 17 is the detail of the marked area in FIG. 16 on an enlarged scale;

FIG. 18 shows a locking position of the handle;

FIG. 19 is a view of the detail of the marked area in FIG. 18 to an enlarged scale.

FIG. 21(*b*) is a top view of a mounting plate for the toggle clamp of FIG. 21(*a*);

FIG. 22 is a partial section view of the toggle clamp of FIG. 21(*a*);

FIGS. 23, 24 illustrate a fifth exemplary embodiment of a clamping tool constructed in accordance with the invention and configured in the form of locking pliers, wherein FIG. 23 is a side view of the locking pliers; and FIG. 24 is a partial sectional view of the locking pliers of FIG. 23.

DETAILED DESCRIPTION OF THE INVENTION

Figure 1:
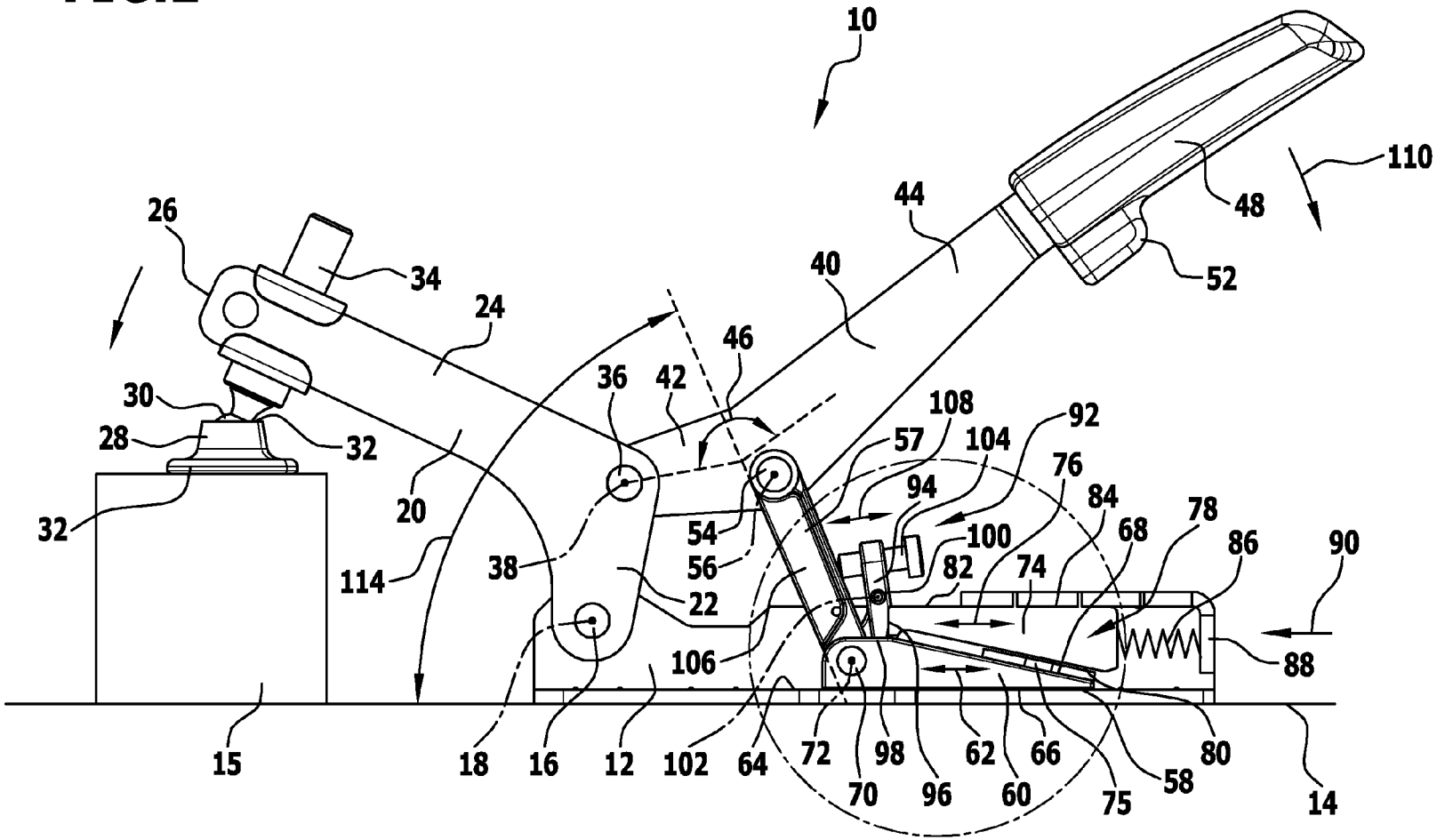
Figure 2:
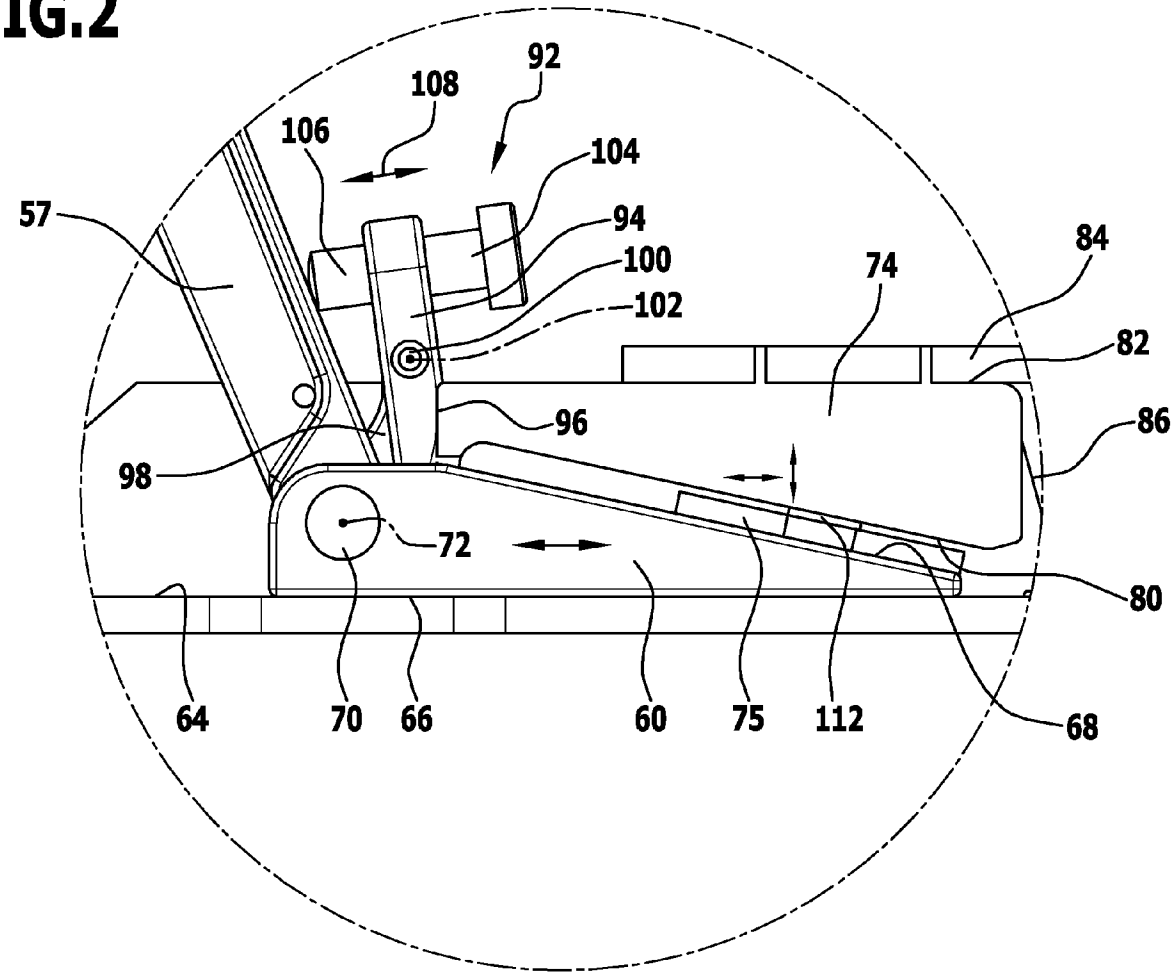
Figure 3:
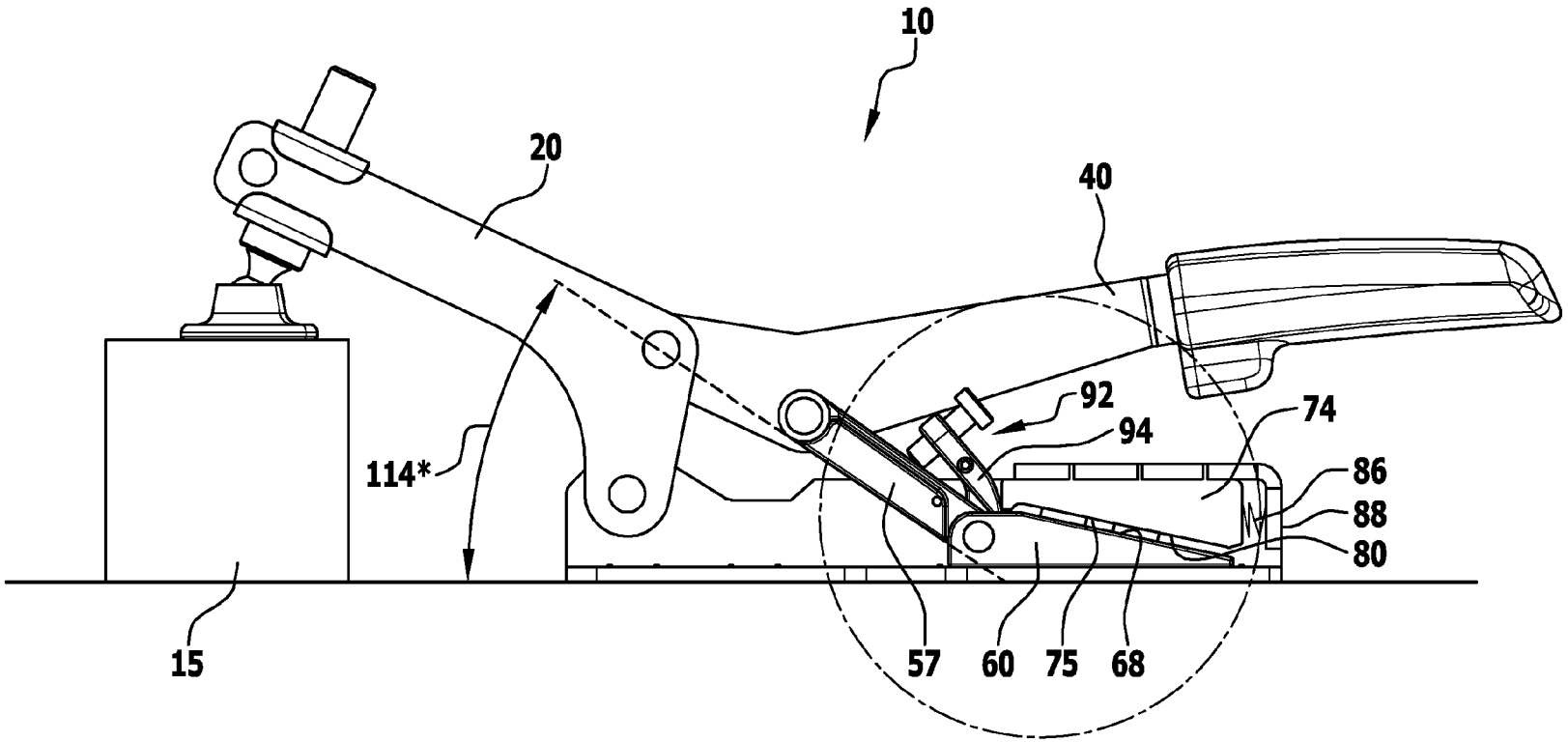
Figure 4:
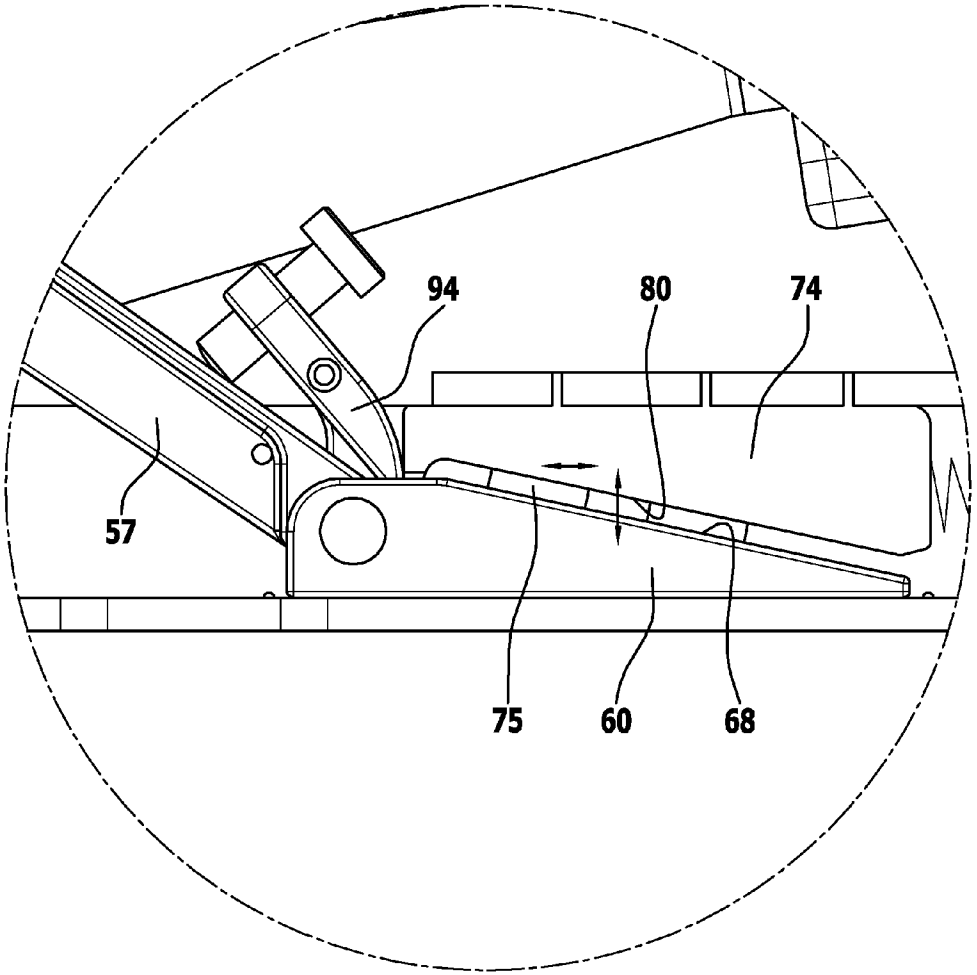

A first exemplary embodiment of a clamping tool constructed in accordance with the invention is a toggle clamp, shown in FIGS. 1 to 8 and indicated therein by 10, and comprises a base 12. By way of the base 12, the toggle clamp 10 is capable of being affixed to a support 14. The support 14 is for example a machine table. The base 12 is capable of being secured to the support 14 by, for example, screws. A workpiece 15 is to be clamped to the support 14 by use of the toggle clamp 10.

A clamping arm 20 is articulated to the base 12 via a first joint 16 which defines a first pivot axis 18. The first pivot axis is oriented perpendicularly to the drawing plane in FIG. 1. In particular, it is oriented parallel to the support 14.

The clamping arm 20 is of angled configuration having a first region 22 and a region 24 oriented transversely to the first region 22. The first joint 16 is positioned in the vicinity of an end of the first region 22.

Located at the second region 24, in the vicinity of an end 26 thereof, is a contact element 28 which is in particular configured as a pressure piece. The contact element 28 is supported on a holding ball 30. The contact element 28 has a contact surface 32 for the workpiece 15. The contact element 28 further has a receptacle 32 which is adapted to the holding ball 30. By the holding ball-and-receptacle connection of the contact element 28, the pivotal position of the contact element 28 relative to the clamping arm 20 is variable.

The holding ball 30 is fixed to the second region 24 of the clamping arm 20 via a holding pin 34.

In an embodiment, a distance of the contact element 28 from the clamping arm 20 is capable of being fixably adjusted. To this end, for example, the holding pin 34 is configured, in particular in a portion thereof, as a threaded pin which is guided on a thread of the clamping arm 20.

A handle 40 is articulated to the clamping arm 20 via a second hinge 36 which defines a second pivot axis 38. The second joint 36 is arranged at the first region 22 in the vicinity of an end facing away from the end which has the first joint 16 positioned in its vicinity. In a state in which the base 12 of the toggle clamp 10 is set on the support, the second joint 36 has a distance from the support 14 that is greater than that of the first joint 16.

The handle 40 is of angled configuration having a first region 42 and a second region 44. The first region 42 and the second region 44 have a finite angle 46 therebetween in the range between, for example, 120° and 150°.

Arranged on the handle 40, at an end region thereof, is a grip element 48 which is made of, for example, a plastics material. The grip element 48 has a contact region 52 for contact with a user's hand.

The second pivot axis 38 is parallel to the first pivot axis 18.

The handle 40 has arranged thereon a third joint 54 which defines a third pivot axis 56. The third joint 54 is spaced apart from the first joint 16 and the second joint 36. The third pivot axis 56 is parallel to the first pivot axis 18. A distance of the third joint 54 from the support 14 depends on a pivotal position of the handle 40. A bridge element 57 is articulated to the handle 40 via the third joint 54. In particular, the third joint 54 is located at the second region 44 of the handle in the vicinity of the transition from the first region 42 to the second region 44.

Formed on the base 12 is a guide 58 for a first wedge element 60. In particular, the first wedge element 60 is guided for linear slidable displacement in the guide 58 on the base 12. A direction of displacement 62 thereof is parallel to a guide surface 64 of the base 12. In particular, the guide surface 64 is of planar configuration. Preferably, the guide surface 64 is oriented parallel to the support 14 when the base 12 is set on the support 14. The distance of the first wedge element 60 from the support is the same independent of the position the first wedge element 60 assumes on the guide 58.

The first wedge element 60 has an underside 66 with which the first wedge element 60 is set on the guide surface 64. The underside 66 is oriented parallel to the guide surface 64.

The first wedge element 60 further comprises a first wedge surface 68 which is oriented at an acute angle with respect to the underside 66, said acute angle being in the range between 10° and 20°, for example.

The bridge element 57 is articulated via a fourth joint 70 to the first wedge element 60 and is permanently connected thereto. The fourth joint 70 defines a fourth pivot axis 72 which is parallel to the first pivot axis 18. The articulation of the bridge element 57 to the first wedge element 60 is outside of the confines of the first wedge surface 68.

The bridge element 57 is of rigid configuration. In particular, it is of rigid configuration, i.e. not movable in itself, between the third joint 54 and the fourth joint 70. It is not interrupted by another joint or the like.

The first wedge element 60 has a second wedge element 74 associated with it. The second wedge element 74 is also linearly guided on the base 12, in a direction of displacement 76 that is parallel to the direction of displacement 62. The second wedge element 74 is arranged above the first wedge element 60. A guide 78 of the second wedge element 74 on the base 12 is configured such that the height position of the second wedge element 74 relative to the guide surface 64 does not change. This is achieved for example by a lateral guide (not visible in the chosen views of the figures).

The second wedge element 74 has a second wedge surface 80 which is adapted to the first wedge surface 68 and is parallel thereto. The second wedge element 74 has, at a position opposite the second wedge surface 80, an upper side 82 via which the second wedge element 74 is guided, for example slidably guided, on a corresponding wall 84 of the base 12 opposite the guide surface 64. The upper side 82 is oriented parallel to the underside 66 of the first wedge element 60.

In an exemplary embodiment, the second wedge element 74 is supported on the base 12 via a spring device 86. In particular, the spring device 86 is supported on a rear wall 88 which is located between the wall 84 and the guide surface 64. Furthermore, the spring device 86, which has one or more compression springs, is fixed, or supported, on a side of the second wedge element 74 that faces towards the rear wall 88.

A direction of force 90 of the spring device 86 is directed away from the rear wall 88 and towards the bridge element 57. In particular, the direction of force 90 is oriented at least approximately parallel to the guide surface 64. The spring device 86 tends to urge the second wedge element 74 in a direction towards the bridge element 57.

Arranged intermediate the first wedge element 60 and the second wedge element 74 is an intermediate element 75. This is arranged and configured parallel to the wedge surfaces 68 and 80 and is guided parallel to the guide surface 64 on the base 12. It is guided on the base 12 in such a manner that it is free to move and "float" in a direction of height relative to the base 12. The first wedge element 60 acts on the second wedge element 74 via the intermediate element 75. The intermediate element 75 absorbs transverse forces and transfers these to the base 12. Transverse movement capability of the wedge elements 60 and 74 is thereby precluded.

The second wedge element 74 has associated with it an adjustment device 92 which provides the capability of adjusting the position into which the second wedge element 74 is capable of being urged by the spring device 86 in a direction towards the bridge element 57. A clamping force is adjustable by the adjustment device 92.

The adjustment device 92 comprises an operative element 94. The operative element 94 has, on a side thereof opposite that side on which the spring device 86 is supported, a contact surface 96 for the second wedge element 74. In particular, the operative element 94 is of rounded configuration in the area of the contact surface 96 thereof.

The operative element 94 is pivotally located on the bridge element 57 via a corresponding holder 98. To this end, a fifth joint 100 is provided which defines a fifth pivot axis 102. The fifth pivot axis 102 is parallel to the first pivot axis 18.

The fifth joint 100 divides the operative element 94 in a first region and a second region. The first region has the contact surface 96 formed thereon. The second region has an adjusting element 104 located thereon. The adjusting element 104 is in particular a screw which is guided via an external thread thereof on an internal thread of the operative element 94. The adjusting element 104 has a region 106 which projects beyond the operative element 94 in a direction towards the bridge element 57. A length of this region 106 towards the bridge element 57 is adjustable. This is indicated in FIG. 1 by the double-headed arrow designated by the reference character 108. The adjusting element 104 is supported via an end of the region 106 thereof on a corresponding outer side of the bridge element 57. A rotational position of the adjusting element 104 at the operative element 94 determines a pivotal position of the operative element 94 relative to the bridge element 57.

The adjusting element 104 is positioned above the wall 84 so that the adjusting element 104 is capable of having a suitable tool, such as a screwdriver, acting upon it for its adjustment.

The toggle clamp 10 is configured as a horizontal clamp. A toggle lever is realized via the joints 16, 36, 54 and 70. The workpiece 15 can be clamped to the support 14 by pivoting the handle 40 in a direction towards the base 12. This direction of motion is indicated in FIG. 1 by the reference character 110. FIG. 1 shows a position of the handle in which the workpiece 15 is not yet clamped. In this position of the handle 40, the spring device 86 urges the second wedge element 74 against the contact surface 96 of the operative element 94. The exact locus of the second wedge element 74 relative to the base 12 is adjusted by the position of the adjusting element 104 on the operative element 94.

The toggle clamp 10 is configured and is in particular dimensioned such that in a first positional range of the handle 40 in which no clamping has yet been applied, wherein a position of the handle 40 within the aforesaid first positional range is shown in FIG. 1, the first wedge surface 68 is farther from the second wedge surface 80 than the height of the intermediate element 75. Due to its free support in the direction of height, the intermediate element 75 is on one side thereof in contact against the first wedge surface 68, and an air gap 112 is formed between an opposite side of the intermediate element 75 and the second wedge surface 80.

In the position illustrated in FIG. 1, the bridge element 57 and the support 14 and hence the guide surface 64 are at a certain angle 114 to each other. When the handle 40 is pivoted in the direction 110, the angle 114 is reduced. This angle reduction also causes the first wedge element 60 to be displaced in a direction of the rear wall 88 by a corresponding pivoting action of the bridge element 57. Confer FIGS. 3 and 4. At a certain position illustrated in FIGS. 3 and 4, a position is then reached where the intermediate element 75 contacting the first wedge surface 68 also contacts the second wedge surface 80, i.e. the air gap has disappeared.

The displacement distance travelled by the first wedge element 60 until it reaches the aforesaid position defines the extent of the self-adjustment capability of the toggle clamp 10.

Proceeding from the aforesaid position for a special angle 114* (FIGS. 3 and 4), when the handle 40 is pivoted further downwardly (FIGS. 5 and 6), then the first wedge element 60 acts upon the second wedge element 74 (with the intermediate element 75 interposed therebetween) and drives a displacement of the second wedge element 74 from the contact surface 96 of the operative element 94 towards the rear wall 88 against the direction of force 90 of the spring device 86. During this phase of movement the first wedge element 60 is, via its first wedge surface 68 and via the intermediate element 75, supported on the second wedge element 74 via the latter's second wedge surface 80. The movable support of the intermediate element 75 permits co-movement thereof. At a certain angle 114, a position of dead centre of the toggle clamp 10 is reached. At this dead centre point, in particular, the bridge element 57 is at least approximately parallel to the clamping arm 20 (and in particular to a direction of longitudinal extent 116 of the second region 24 of the clamping arm 20), i.e. piercing points of the pivot axes 38, 56, 72 are on one line with each other.

The clamping arm 20 securely presses on the workpiece 15 via the contact element 28 and clamps it against the support.

Figure 5:
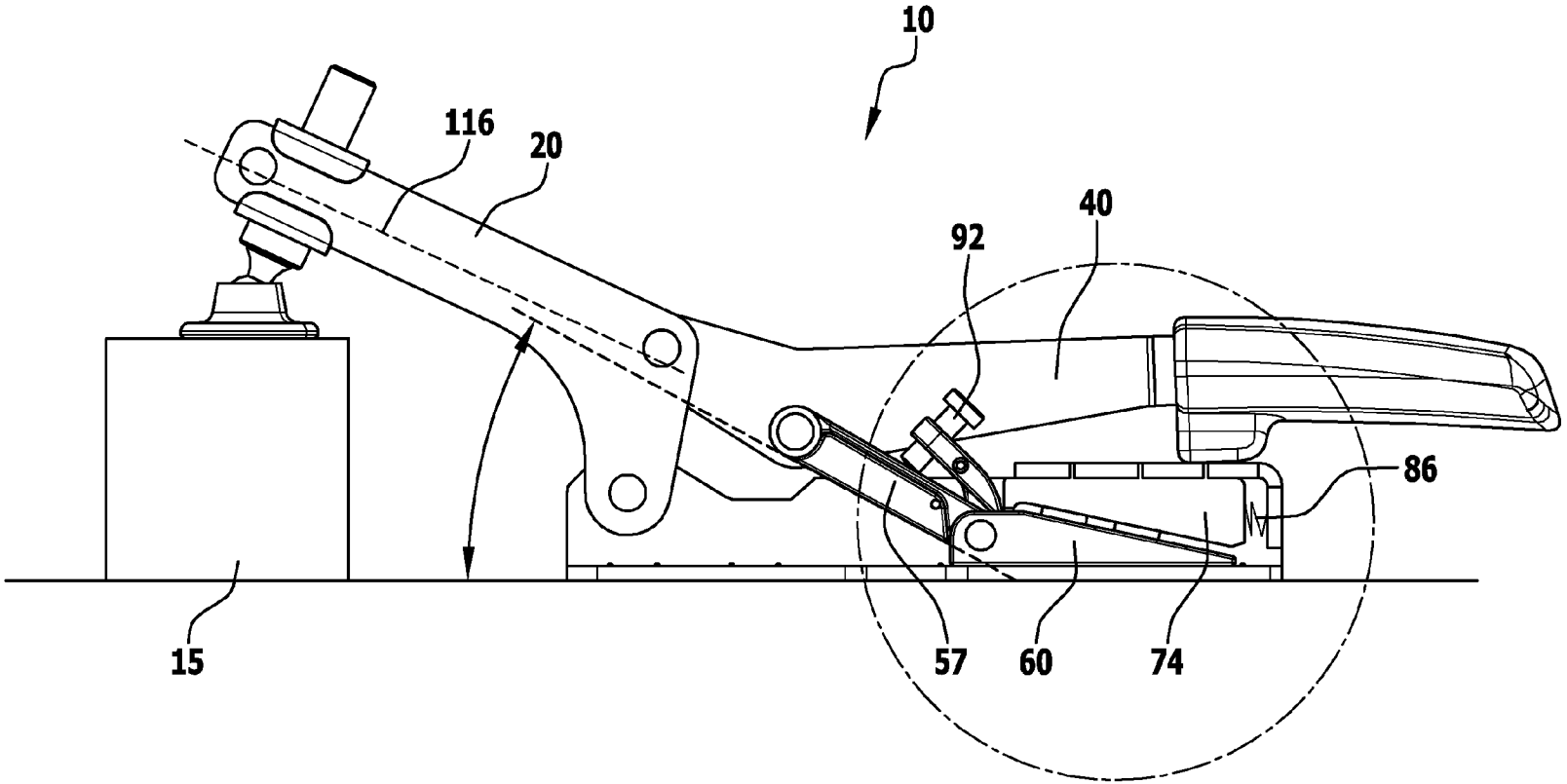
Figure 6:
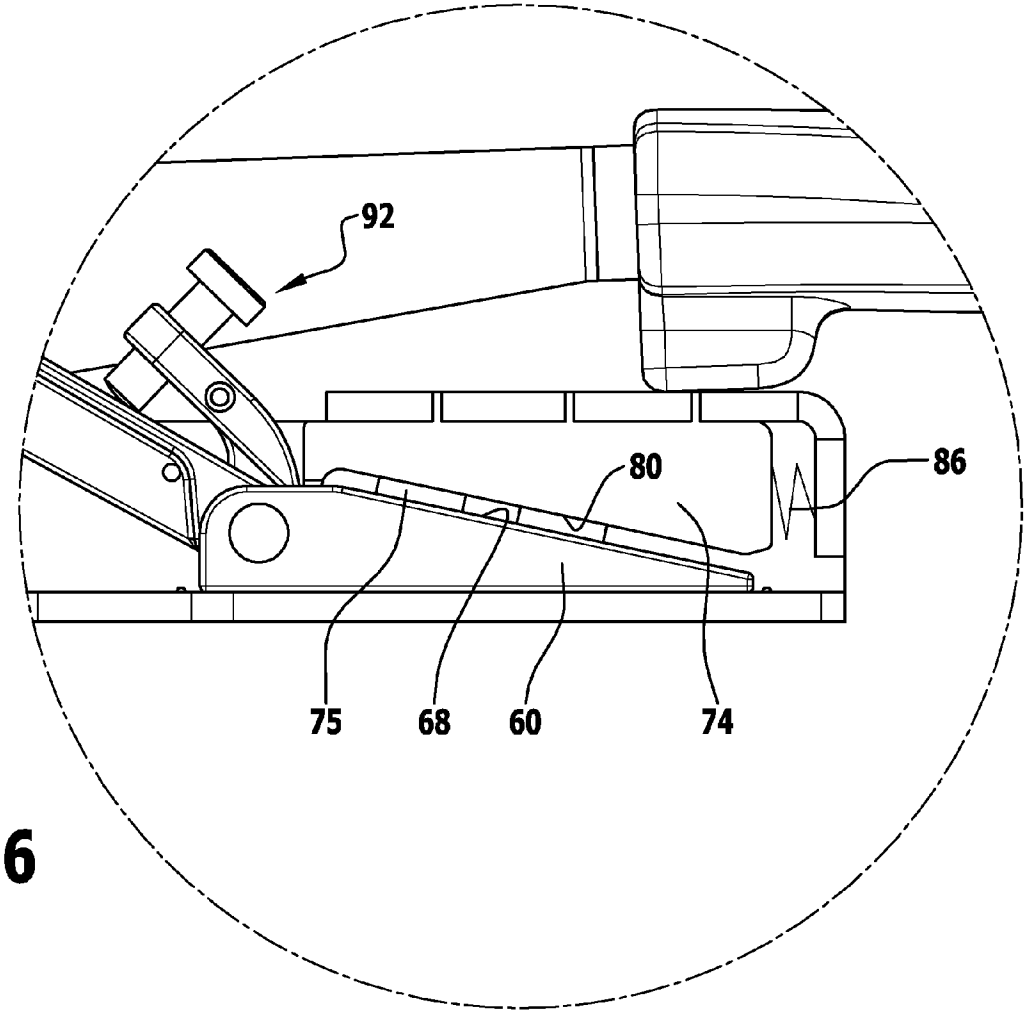

FIGS. 5 and 6 show a position of the handle 40 which is already slightly below the toggle lever dead centre point.

In this condition, the workpiece 15 is securely and firmly clamped in place between the contact element 28 on the clamping arm 20 and the support 14.

The clamping force (the toggle lever force) is, in principle, capable of being adjusted by the adjustment device 92.

The bridge element 57, configured as a rigid element, is directly and permanently connected to the first wedge element 60 and is directly articulated to the latter via the fourth joint 70. The result is simplicity in construction with a wide range of variation for clamping height (workpiece height).

The adjustment device 92 including the adjusting element 104 is arranged on the bridge element 57. In particular, the operative element 94 is pivotally arranged on the bridge element 57. This provides a simple way of adjusting the corresponding clamping force (toggle lever force) by the position of the second wedge element 74 in the first positional range of the handle 40.

The adjusting element 104 is easily accessed by use of a standard tool, such as a screwdriver, in order to adjust the corresponding force.

The displacement capability of the first wedge element 60 allows compensating for different workpiece heights to a certain extent; a point of support of the clamping arm 20 is variable. The toggle clamp 10 is thereby self-adjusting ("self-adjusting toggle clamp").

A second exemplary embodiment of a clamping tool constructed in accordance with the invention and configured in the form of a toggle clamp, illustrated in FIGS. 7 to 13 and indicated therein by 120, comprises a base 122 for fixing to the support 14. A clamping arm 126 is pivotally articulated to the base 122 via a first joint 124. The clamping arm 126 has, in principle, the same configuration as the clamping arm 20 described above. The clamping arm 126 also has a contact element 28 located thereon as described above.

A handle 130 is pivotally articulated to the base 122 via a second joint 128. The second joint 128 is spaced at a height distance from the first joint 124.

The handle has located thereon a guide 132 for a first wedge element 134 and a second wedge element 136.

A bridge element 138 is pivotally articulated to the clamping arm 126 via a third joint 140. The bridge element 138 is pivotally articulated via a fourth joint 142 to the first wedge element 134 and is permanently connected thereto.

The first wedge element 134 is capable of being displaced parallel to the handle 130 via the guide 132. The second wedge element 136 is positioned above the first wedge element 134. It is urged in a direction towards the bridge element 138 via a spring device 144.

The first joint 124, the second joint 128, the third joint 140 and the fourth joint 142 form a toggle lever.

Located on the bridge element 138 is an adjustment device which is, in principle, of identical configuration as that of the adjustment device 92. Therefore, the same reference characters are used as those for the adjustment device 92. An operative element 94 acts upon the second wedge element 136 via a contact surface 96.

The second wedge element 136 has a recess 146 in the form of, for example, an elongated hole recess. The recess 146 is formed as a through-recess. The through-direction of this recess 146 is perpendicular to the drawing plane of FIGS. 7 and 8. The second joint 128 is arranged in the recess 146 and is fixedly positioned with respect to the base 122. The recess 146 provides displacement capability for the second wedge element 136 on the handle 130.

In order to clamp a workpiece to the support 14, the handle 130 is pivoted in a direction 148 towards the base. The toggle clamp 120 is also a horizontal clamp. By the aforesaid pivoting action, the bridge element 138 pushes the first wedge element 134 in a direction towards a grip element 150 which is located on the handle 130.

Figure 7:
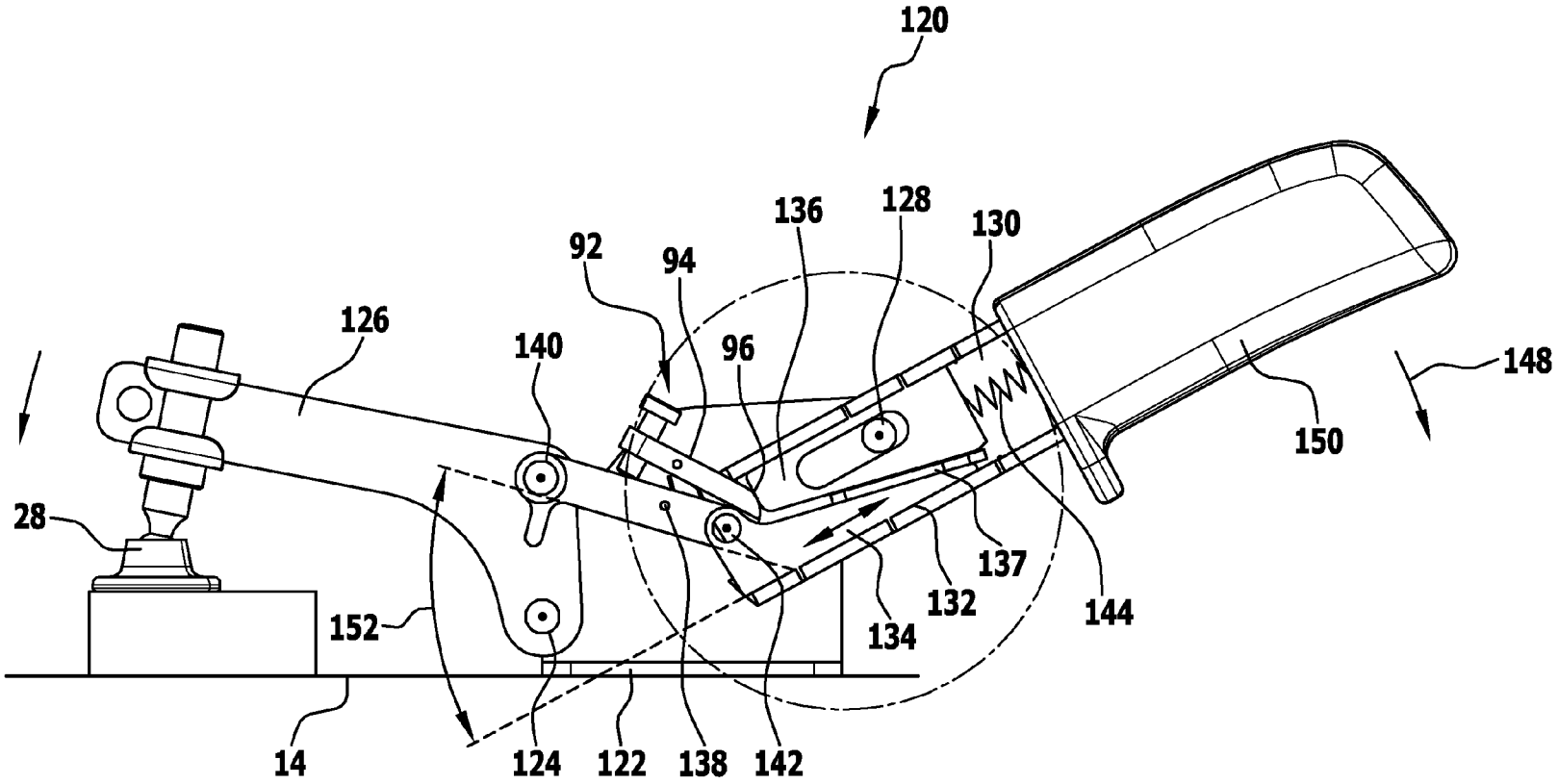
Figure 8:
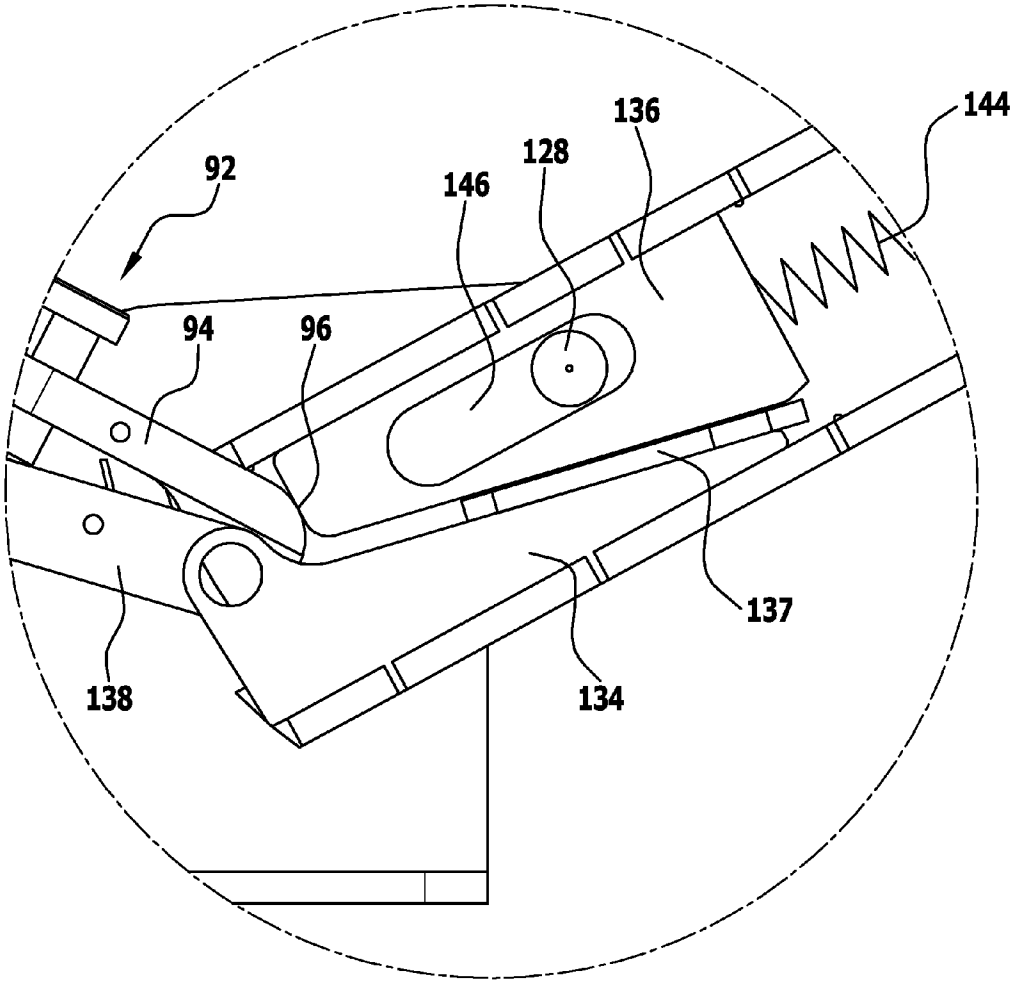

Shown in FIGS. 7 and 8 is a position of the handle 130 within a first positional range in which a corresponding wedge surface of the first wedge element 134 is spaced apart from the corresponding wedge surface of the second wedge element 136. The position of the second wedge element 136 on the handle 130 is determined by the adjustment of the adjustment device 92. The position illustrated in FIGS. 7 and 8 corresponds to the position which is shown for the toggle clamp 10 in FIGS. 1 and 2.

Figure 9:
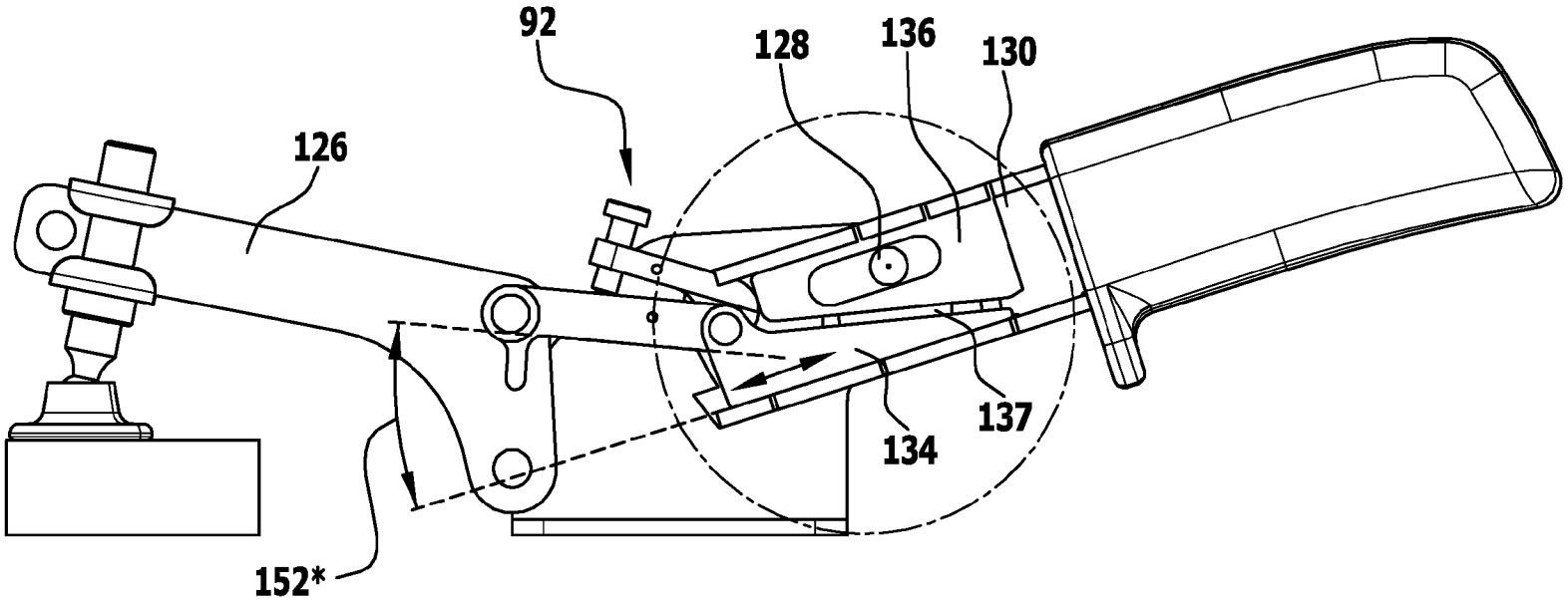
Figure 10:
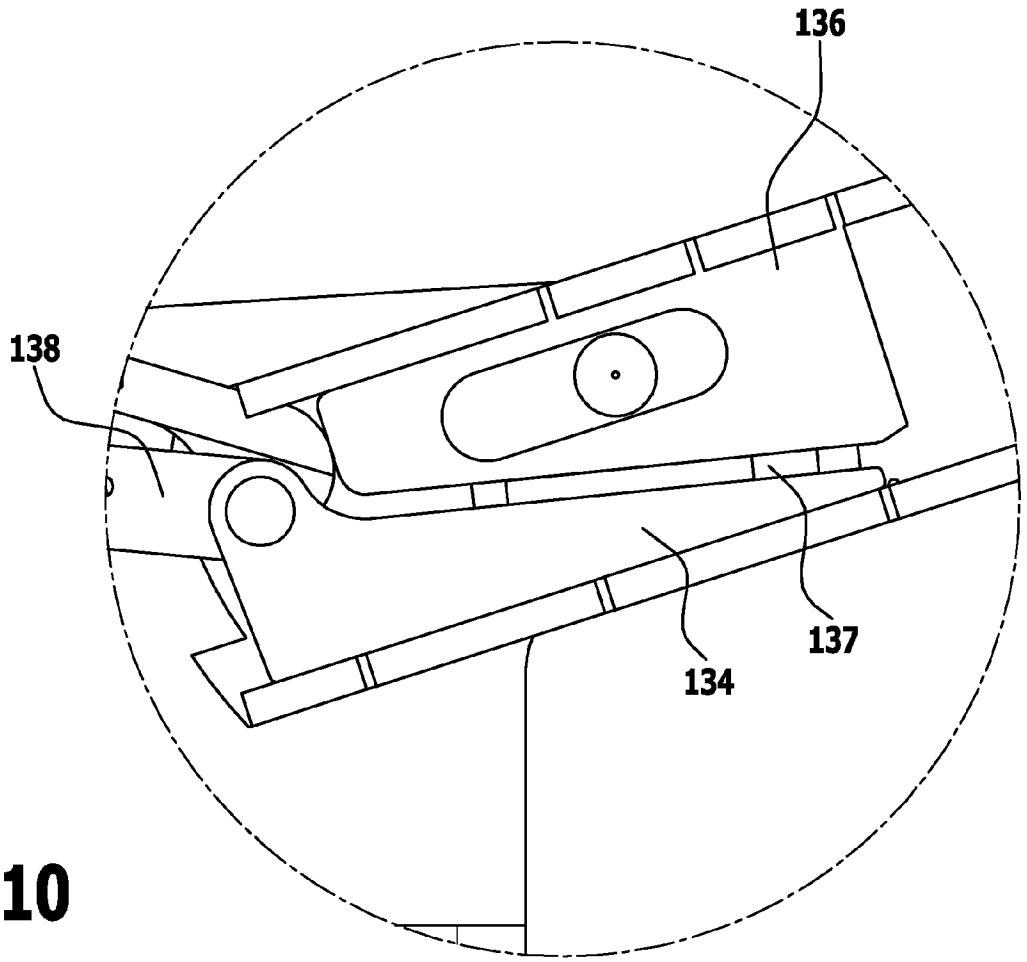

The handle 130, including the guide 132, and the bridge element 138 are at a certain angle 152 to each other. Pivoting the handle 130 towards the base 122 causes said angle 152 to be reduced. As shown in FIGS. 9 and 10, the distance between the first wedge surface of the first wedge element 134 and the second wedge surface of the second wedge element 136 is then reduced and an intermediate element 137 contacts these surfaces. Proceeding from the corresponding angular position 152*, further reduction of the angle causes displacement, driven by the first wedge element 134, of the second wedge element 136 in a direction towards the grip element 150 (cf. FIGS. 11 and 12). This movement is realized against the spring force of the spring device 144. The first wedge element 134 is also displaced away from the contact surface 96 of the adjustment device 92.

A toggle lever dead centre position is at least approximately reached when the angle 152 is 0°, i.e. when the handle 130 and the bridge element 138 are oriented parallel to each other or piercing points of pivot axes of the second joint 128, the third joint 140 and the fourth joint 142 are on one line with each other.

Figure 11:
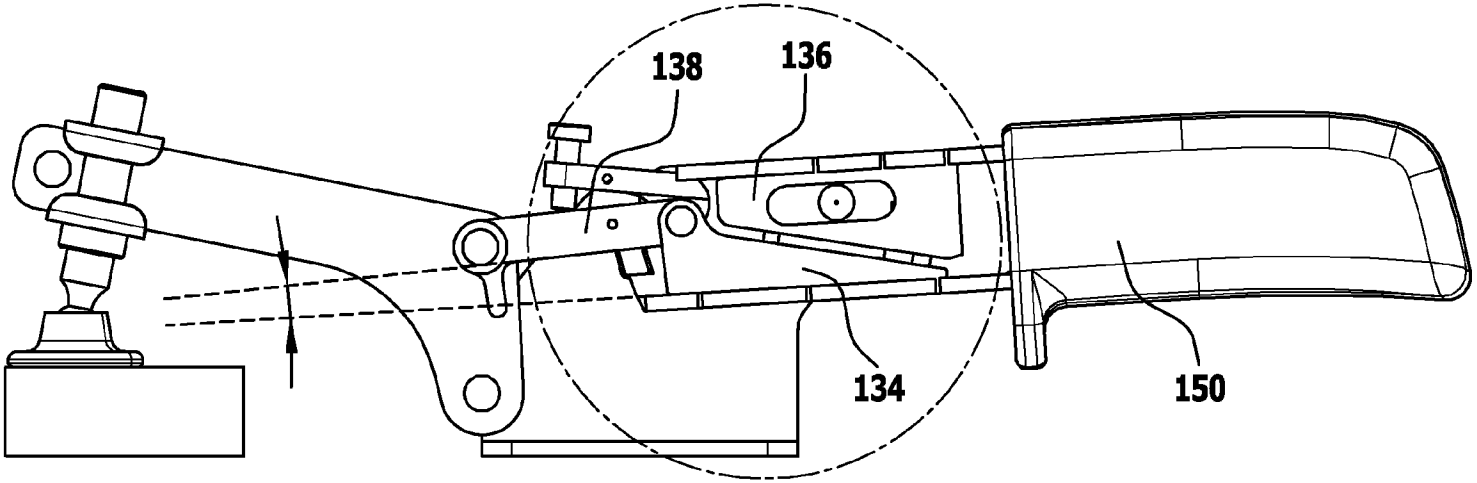
Figure 12:
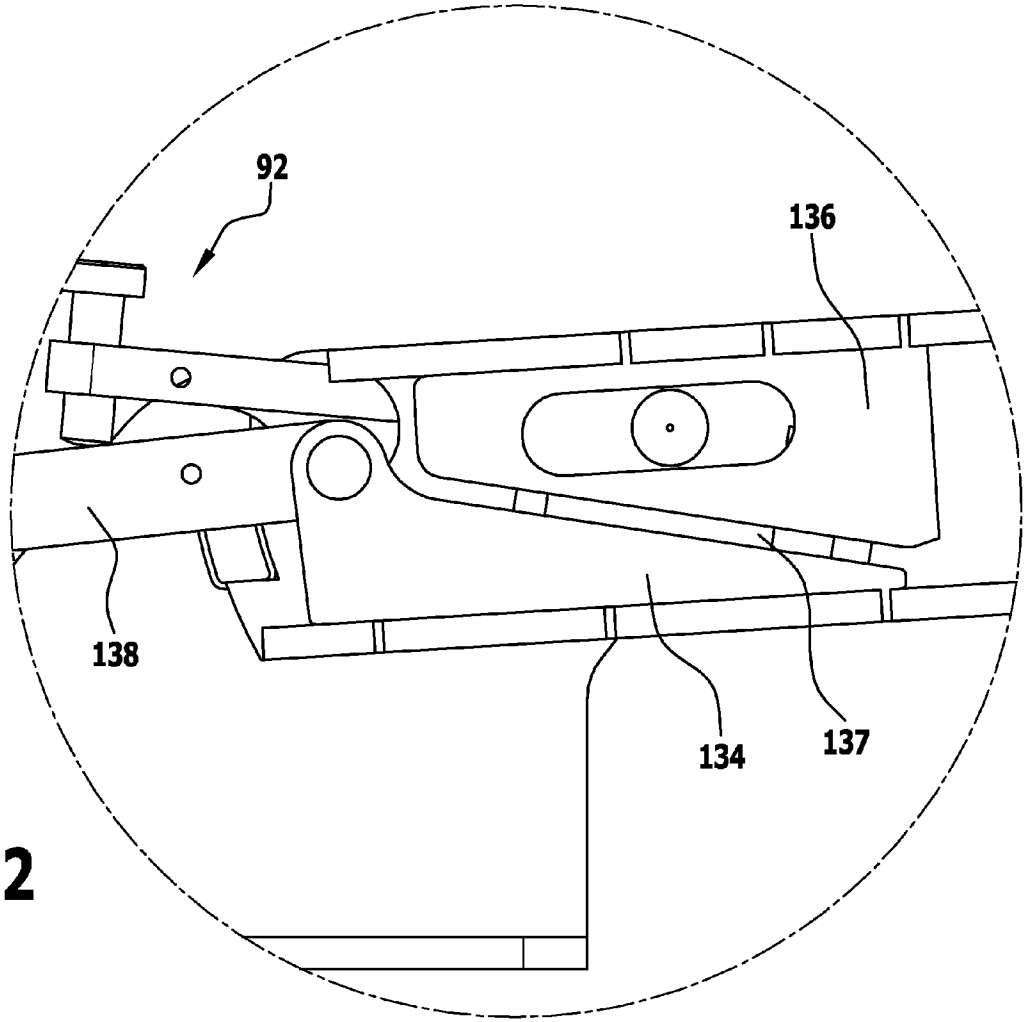

FIGS. 11 and 12 illustrate a position in which the handle 130 is already below dead centre.

Again, the adjustment device 92 allows the clamping force (toggle lever force) to be adjusted.

In the toggle clamp 120, the bridge element 138 is also of rigid configuration. It is permanently pivotally connected to the first wedge element 134 and is articulated to the latter.

Figure 13:
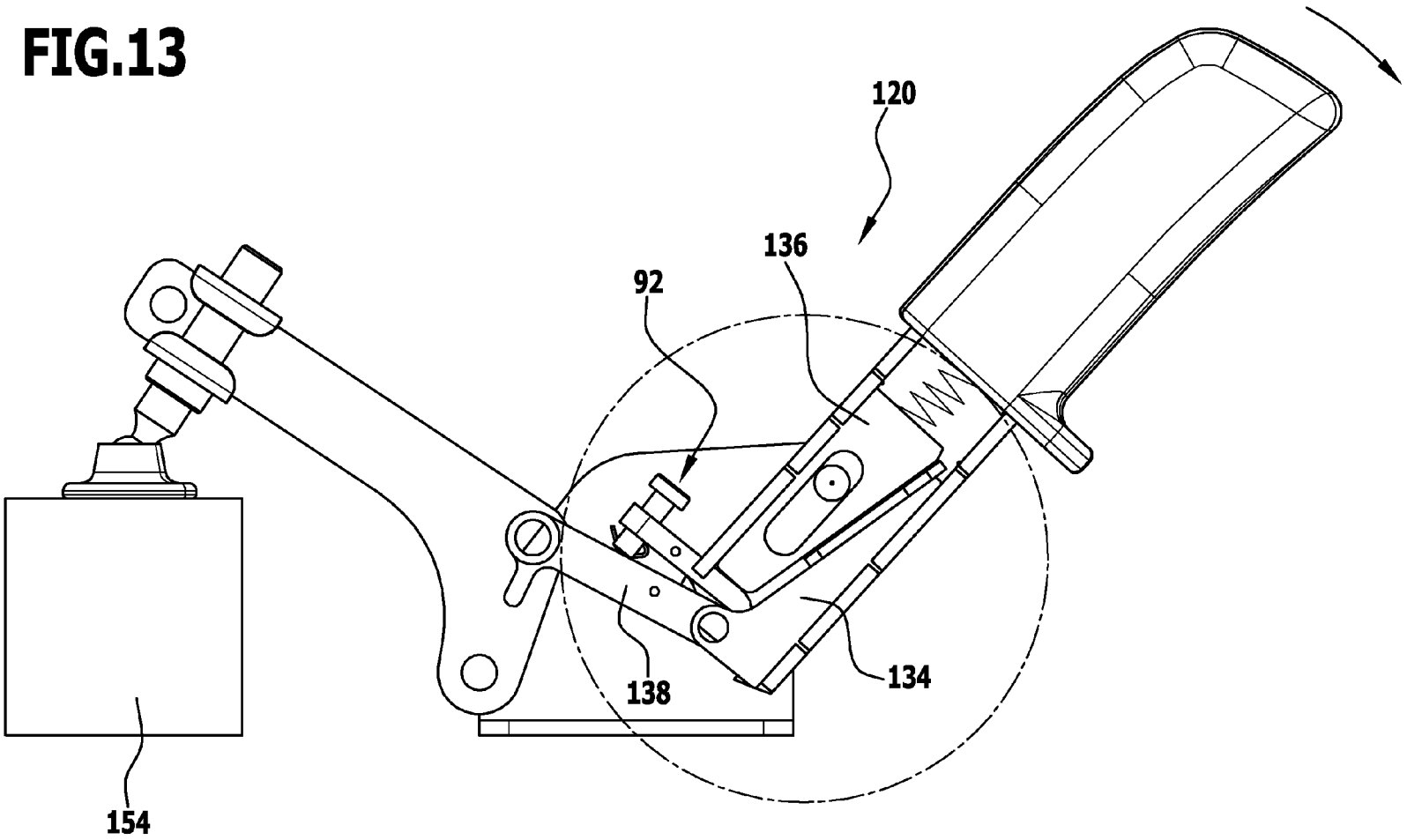
FIG. 13 is the toggle clamp of FIG. 9 being used on a larger-sized workpiece.

FIG. 13 illustrates an exemplary embodiment corresponding to FIG. 7 but where a workpiece 154 being clamped has a greater height.

A third exemplary embodiment of a clamping tool constructed in accordance with the invention and configured in the form of a toggle clamp, illustrated in FIGS. 14 to 20 and indicated therein by 160, comprises a base 162. A clamping arm 167 is pivotally articulated to the base 162 via a first joint 164 having a first pivot axis 166 (which is perpendicular to the drawing plane in FIG. 14). The clamping arm in turn has located thereon a contact element corresponding to the contact element 28. A handle 172 is pivotally articulated to the base 162 via a second joint 168 having a second pivot axis 170. The second pivot axis 170 is parallel to the first pivot axis 166. The first joint 164 and the second joint 168 are at the same height.

The clamping arm 167 has, at a position above the first joint 164, a bridge element 178 pivotally articulated thereto via a third joint 174 having a third pivot axis 176.

Guided for linear displacement on the handle 172, on a guide 180, is a first wedge element 182. The bridge element 178 is permanently pivotally articulated to the first wedge element 182 via a fourth joint 184 having a fourth pivot axis 186.

The first wedge element 182 has associated with it a second wedge element 188 which is likewise linearly displaceable on the handle 172. Furthermore, the bridge element 178 has positioned thereon an adjustment device corresponding to the adjustment device 92. Therefore, the same reference character is used as in the first exemplary embodiment and in the second exemplary embodiment.

The toggle clamp 160 is configured as a vertical clamp. Clamping a workpiece to a support is achieved when the handle 172 is pivoted in a direction 190 away from the base 162.

The guide 180 and the bridge element 178 have an angle 192 therebetween. When the handle 172 is pivoted in the direction 190, the angle 192 is reduced (cf. FIGS. 14 and 16).

The second wedge element 188 is supported on a rear wall 196 via a spring device 194.

Figure 14:
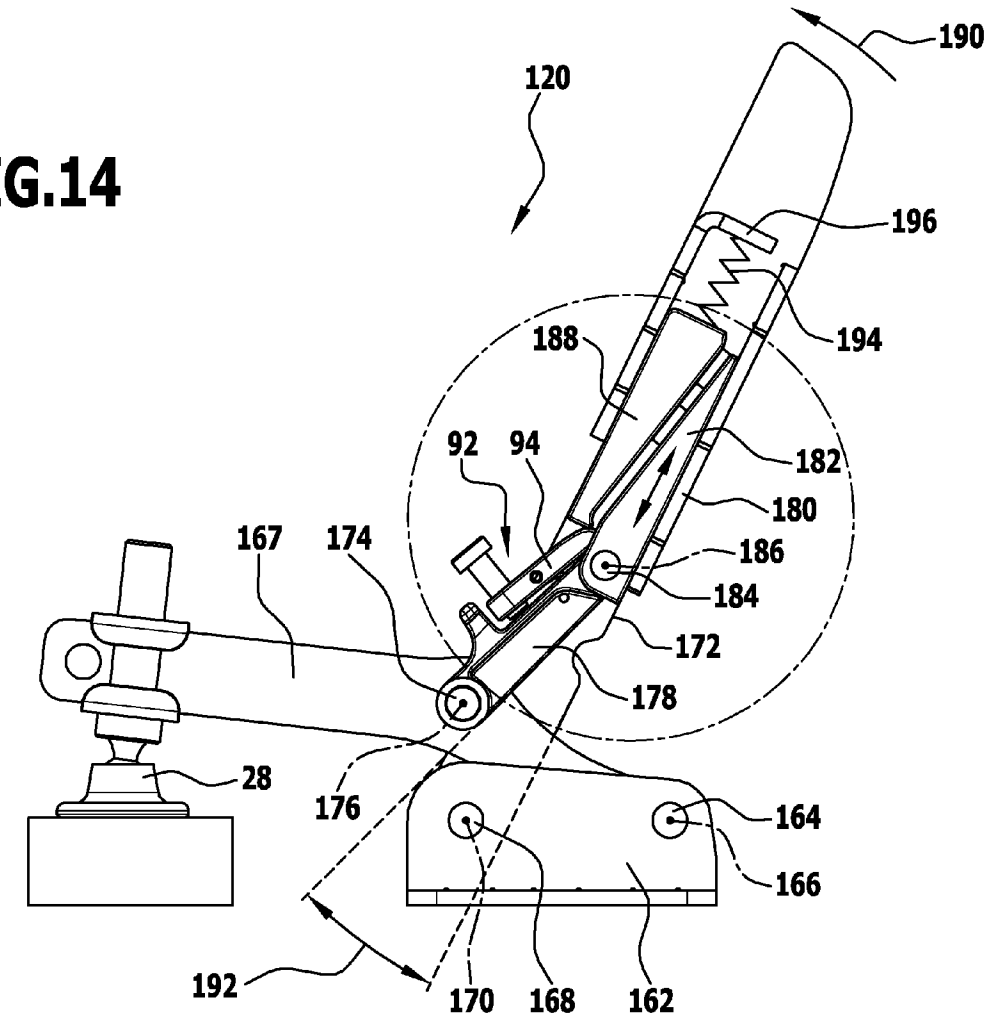
Figure 15:
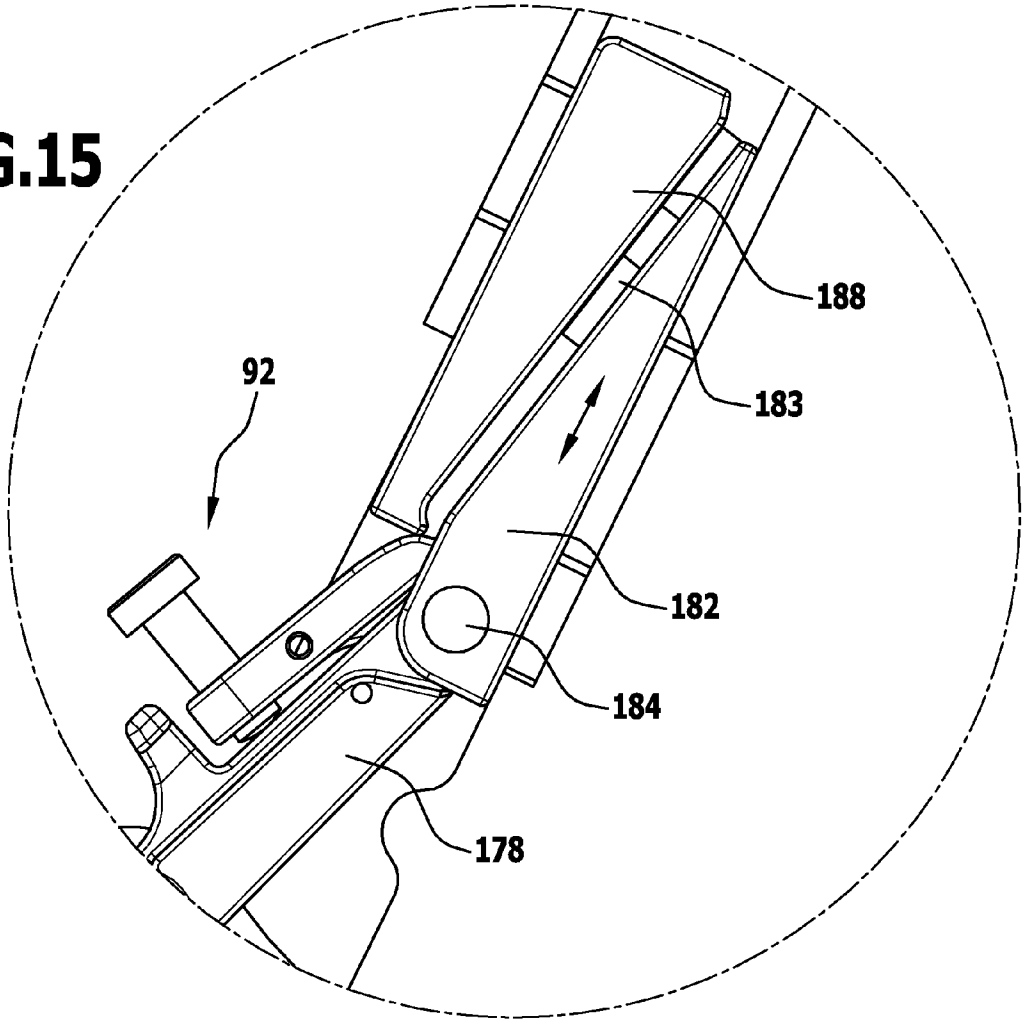
Figure 16:
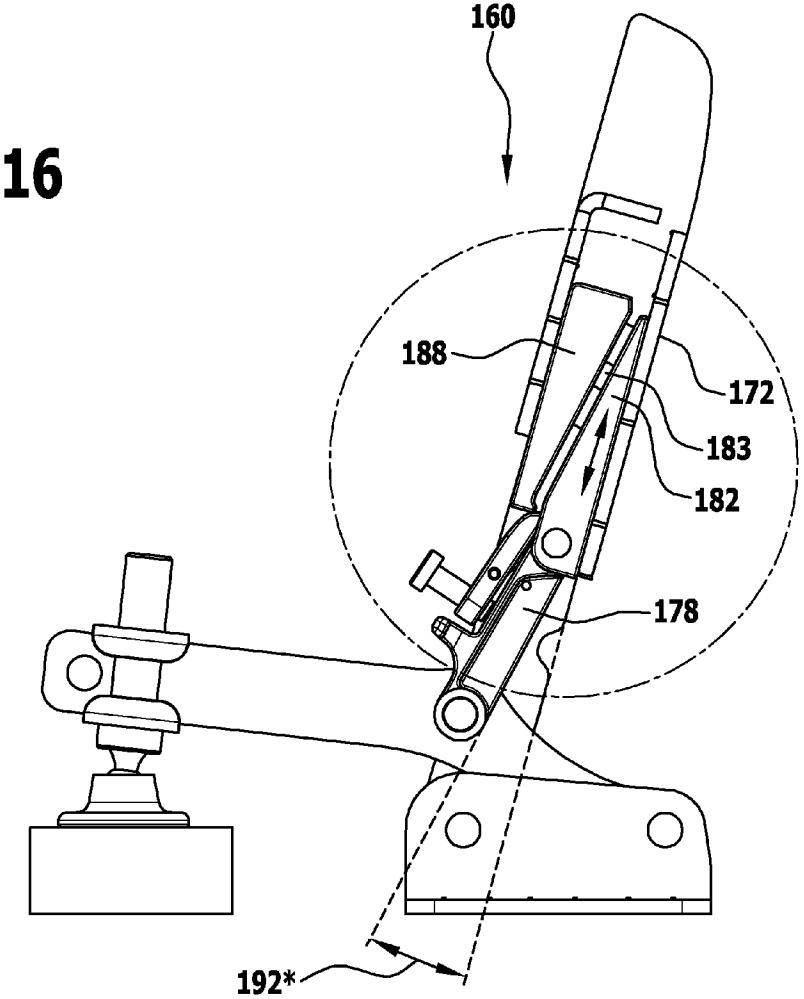
Figure 17:
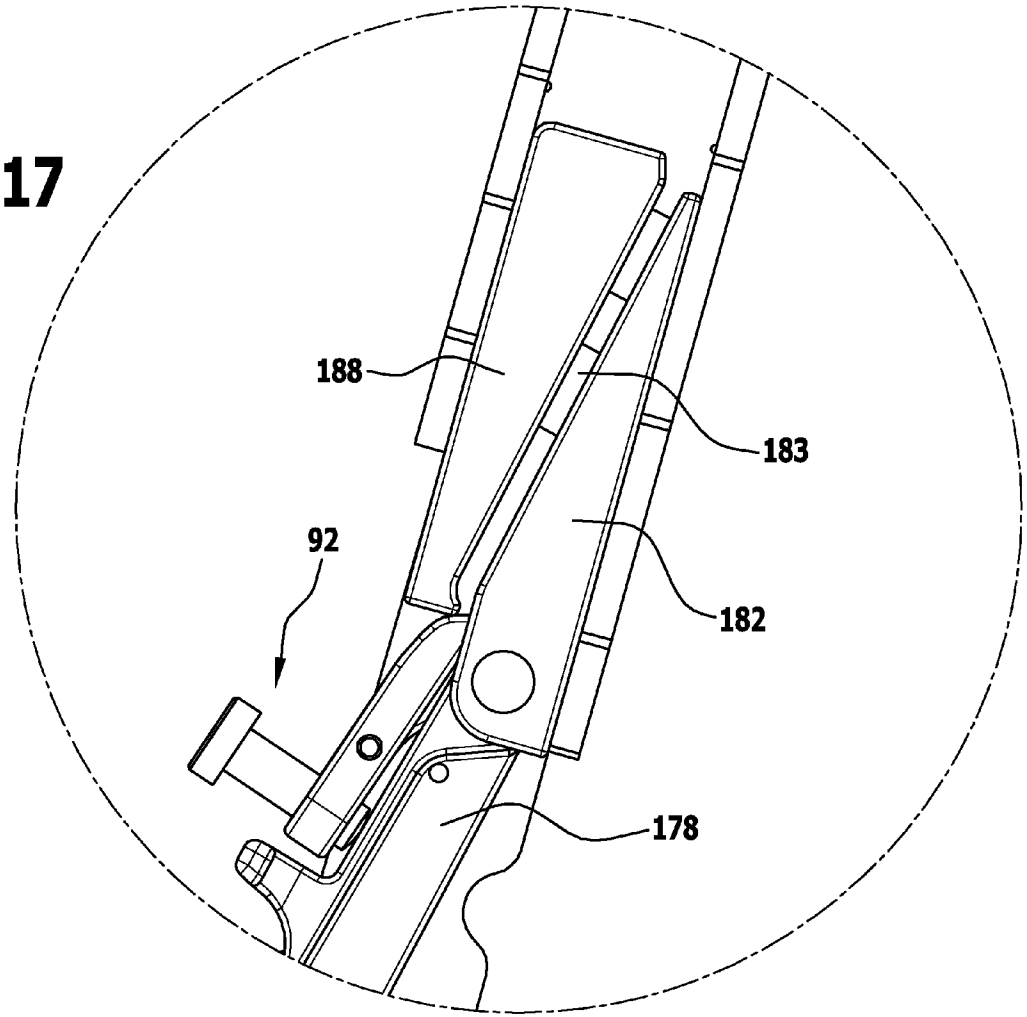
Figure 18:
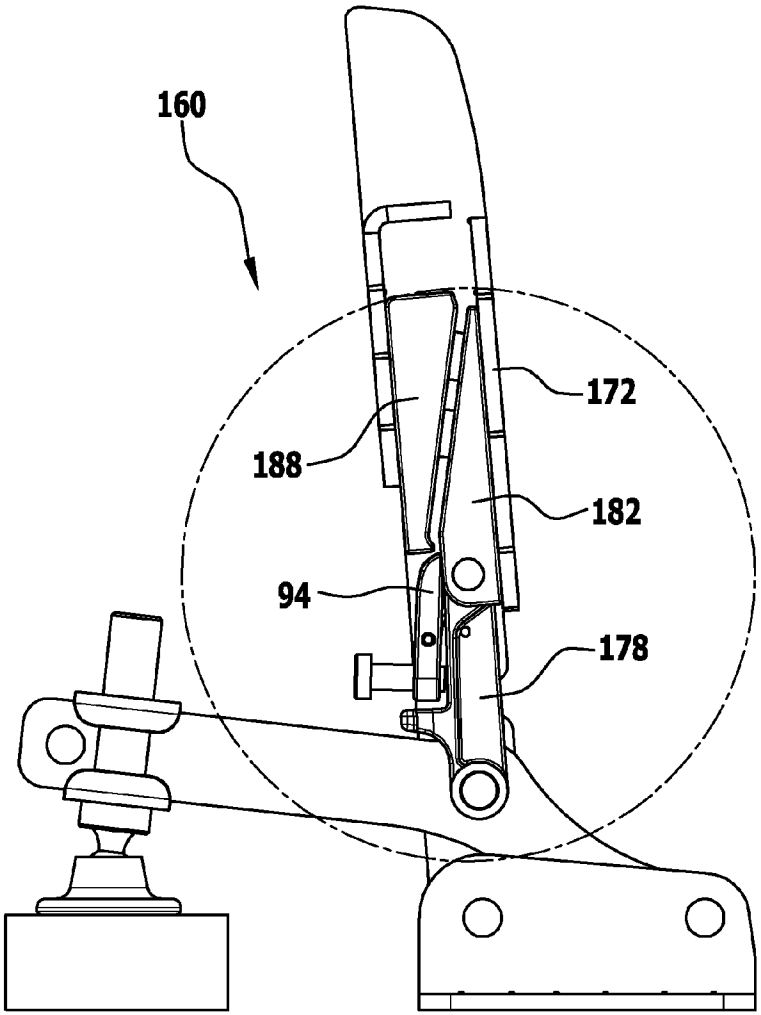
Figure 19:
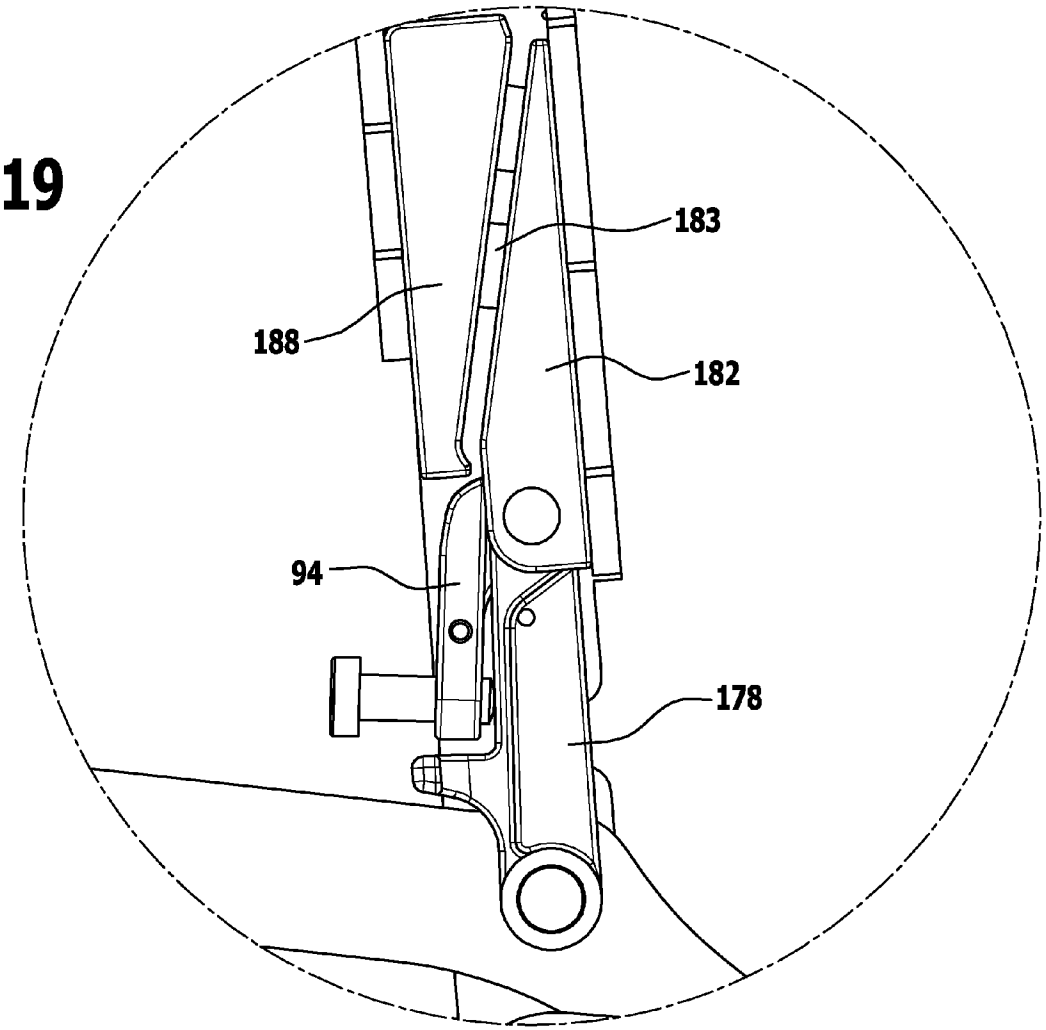

FIGS. 14 and 15 depict a position within a first positional range of the handle 172 in which an intermediate element 183 on a first wedge surface of the first wedge element 182 does not yet contact the second wedge element 188. The second wedge element 188 is moved in a direction towards the corresponding operative element 94 of the adjustment device 92 by the spring device 194 and is in contact against the operative element 94. The adjusted position (pivotal position) of the operative element 94 relative to the bridge element 178 determines this starting position of the second wedge element 188.

Further pivoting of the handle 172 then causes the angle 192 to be reduced. At angle 192* (FIGS. 16 and 17), the intermediate element 183 is then in contact against the first wedge element 182 and against the second wedge element 188. Starting at this position, a second positional range is then reached. Further pivoting of the handle 172 causes the first wedge element 182 to act upon the second wedge element 188 and to drive the latter's displacement against the spring force of the spring device 194 and away from the operative element 94.

A toggle lever dead centre position is reached when the angle 192 is 0°, i.e. when the guide 180 of the handle 172 and the bridge element 178 are at least approximately parallel to each other or piercing points of the pivot axes 170, 176 and 186 are on one line with each other.

Figure 20:
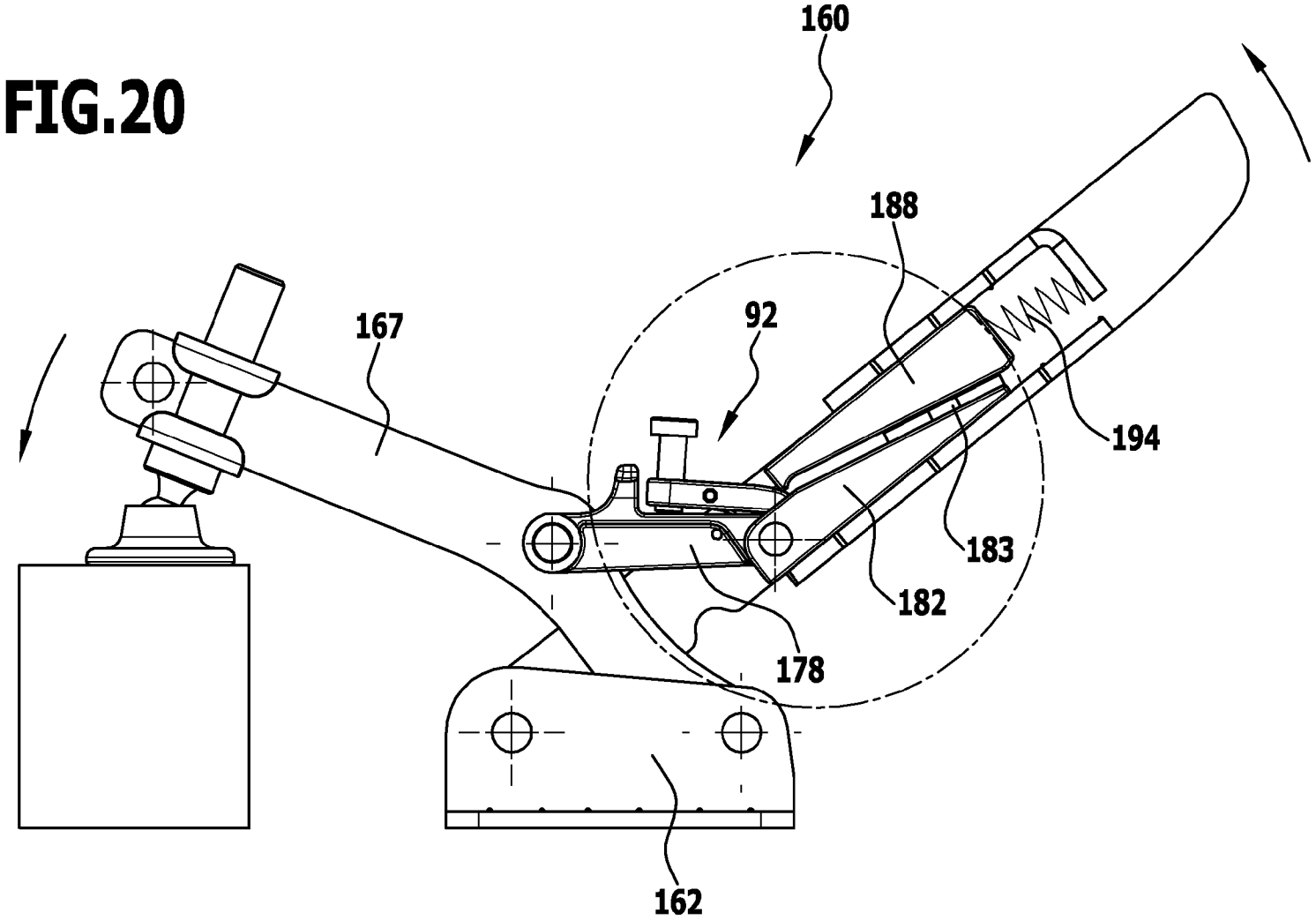
FIG. 20 is the toggle clamp of FIG. 14 being used on a larger-sized workpiece.

FIG. 20 shows the toggle clamp 160, with a larger-size workpiece being clamped.

In the toggle clamps 10, 120, 160 constructed in accordance with the invention, a corresponding bridge element 57, 138, 178 is of rigid configuration and is directly and permanently articulated to the first wedge element 60, 134, 182, i.e. a permanent pivotal connection exists between the first wedge element 60, 134, 182 and the bridge element 57, 138, 178. The adjustment device 92 is positioned on the corresponding bridge element 57, 138, 178 and therefore its pivot point is the same as that of the corresponding bridge element 57, 138, 178.

This results in a simple construction with a wide range of variation for the clamping action, i.e. with a wide range of variation for the height of workpieces capable of being clamped.

The clamping force (toggle lever force) can be adjusted via the adjustment device 92 in a simple manner. In particular, access to the adjusting element 104 can be realized in a simple manner. The clamping force can be at least approximately constantly fixed over a wide angular range/height range of workpieces.

Figure 21A:
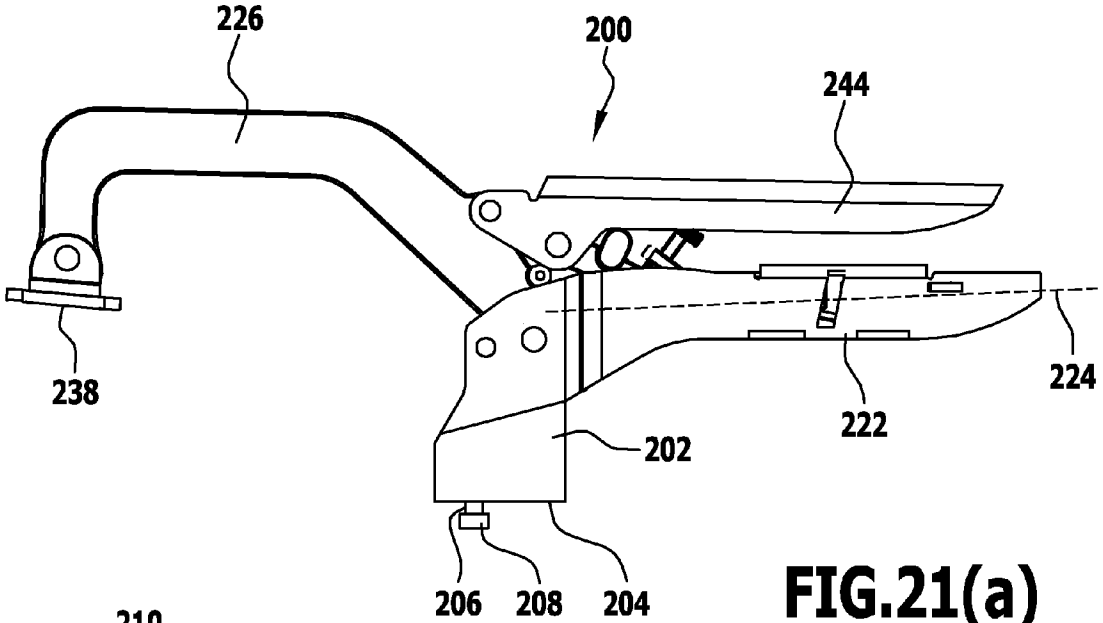
FIGS. 21, 22 illustrate a fourth exemplary embodiment of a clamping tool constructed in accordance with the invention and configured in the form of a toggle clamp, wherein FIG. 21(*a*) is a side view of the toggle clamp.
Figure 21B:
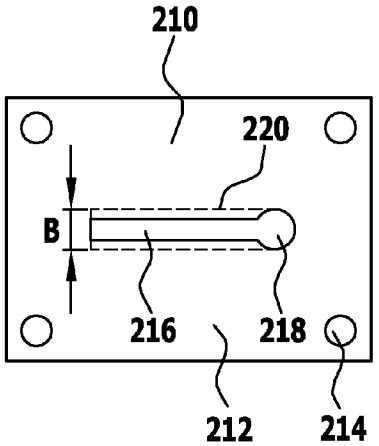
Figure 22:
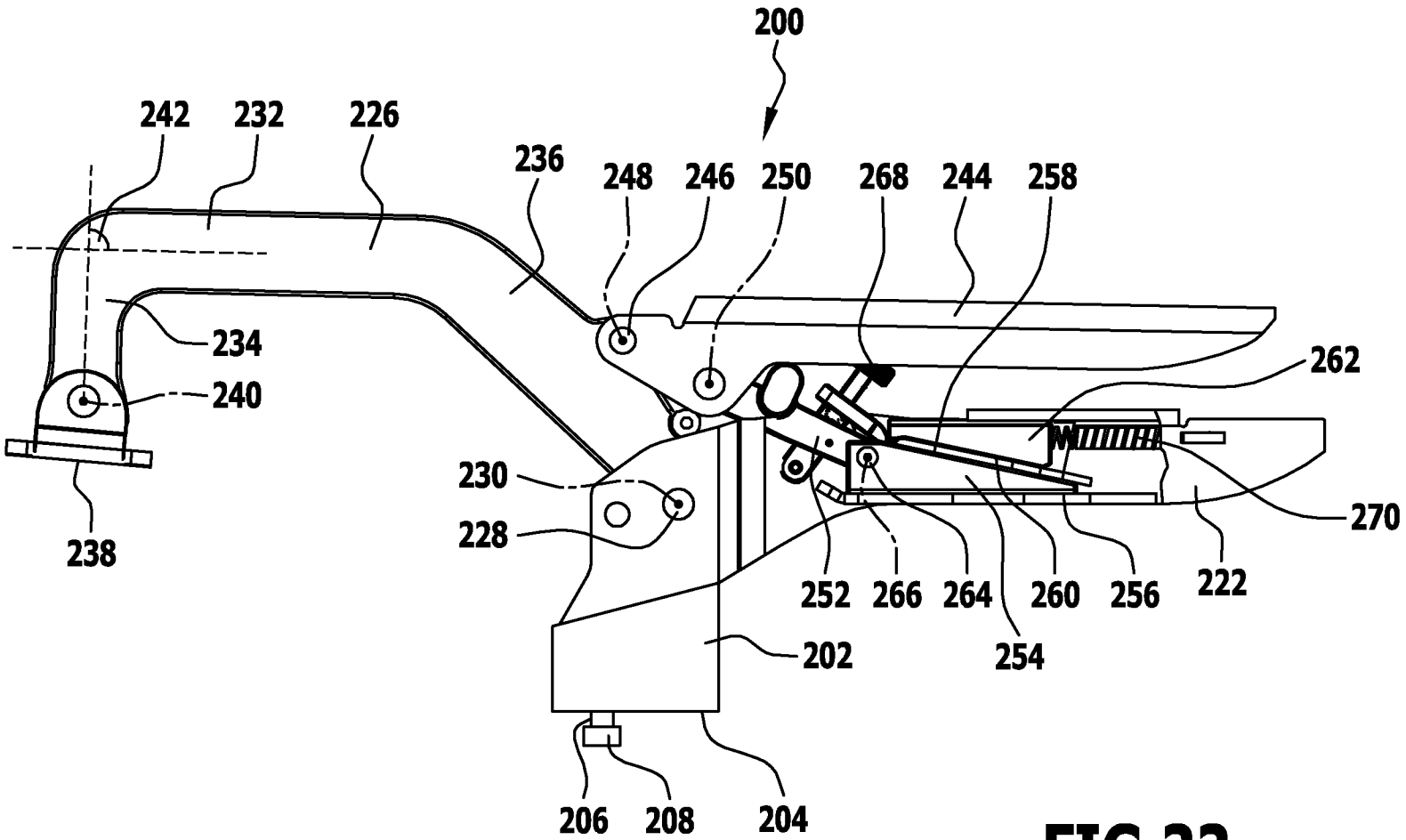

A fourth exemplary embodiment of a clamping tool constructed in accordance with the invention, shown in FIGS. 21, 22 and denoted therein by 200, is a toggle clamp. Said toggle clamp 200 comprises a base 202. The base 202 has an underside 204. Arranged on the underside 204 is a pin 206 having a head 208 located thereon. The head 208 has a diameter greater than that of the pin 206. The head 208 is spaced apart from the underside 204.

The base 202 and therefore the clamping tool 200 is capable of being fixed to an application via the pin 206 including the head 208 (FIG. 21(*b*)). For example, a slot 210 is arranged in a corresponding plate 212, said plate 212 being capable of being affixed to an application, for example a machine table, via corresponding fastening elements 214, such as screws.

The slot 210 has a first region 216 and a second region 218 connected to the first region 216. The second region 218 is configured such that the head 208 is capable of extending therethrough. The first region 216 is configured such that it forms a barred area for the head 208.

Formed rearwardly of the slot 210 in the plate 212 is a groove 220. The groove 220 has a width B that is greater than that of the slot 210 in the first region 216 thereof. The barred area for the head 208 is formed by a wall of the groove 220 at the slot 210.

In the second region 218, the head 208 is capable of being extended into the groove 220. When the base 202 with the pin 206 and the head 208 is slid into the first region 216, then the head 208 can come into contact against the barred area, with the pin 206 extended through the slot 210. Axial fixing can thereby be achieved.

For example, the pin 206 including the head 208 is formed as a screw and the base 202 can be clamped to the plate 212, wherein the head 208 is then in contact against the barred area in the groove 220 and the underside 204 is then in contact against the upper side of the plate 212.

For example, the base 202 is fixed to the plate 212 separately from the application and thereafter the plate 212 is fixed to the application by way of the fastening elements 214.

Fixedly located on the base is a handle element 222.

In an exemplary embodiment, the handle element 222 has a direction of longitudinal extent 224 which is transverse and in particular perpendicular to the underside 204.

Pivotally articulated to the base 202 is a (first) clamping arm 226. It is pivotable via a corresponding pivot bearing 228 about a first pivot axis 230. The first pivot axis 230 is oriented transversely and, in particular, perpendicularly to the direction of longitudinal extent 224 of the handle element 222. In FIGS. 21(*a*) and 22, the first pivot axis 230 is oriented perpendicularly to the drawing plane.

The clamping arm has a middle first region 232 which has located thereon a second region 234 extending towards the one side and a third region 236 extending towards the other side. In particular, the first region 232, the second region 234 and the third region 236 are connected together in one piece. The clamping arm 226 is articulated to the base 202 via the third region 236.

Arranged on the second region 234 is a contact element 238 for a workpiece. This contact element 238 is located on the second region 234 for pivotal movement about a pivot axis 240. In particular, the pivot axis 240 is oriented parallel to the first pivot axis 230, or parallel to the underside 204.

The second region 234 is in an angled relationship relative to the first region 232. In particular, a corresponding angle is in the range between 70° and 110° and is in particular a right angle.

The third region 236 is at an acute angle to the first region 232.

Articulated to the clamping arm 226 is a handle 244. A corresponding pivot bearing 246 is provided which enables the handle 244 to be capable of pivoting relative to the clamping arm 226 about a second pivot axis 248. The second pivot axis 248 is parallel to the first pivot axis 230.

Articulated to the handle 244 for pivotal movement about a third pivot axis 250 is a bridge element 252.

Linearly guided on the handle element 222 of the base 202 via a corresponding guide 256 that is arranged on the handle element 222 is a first wedge element 254. The first wedge element 254 has a first wedge surface 258 that faces towards a second wedge surface 260 of a second wedge element 262. The second wedge element is also linearly guided on the handle element 222. The second wedge surface 260 is supported on the first wedge surface 258. Displacement of the first wedge element 254 causes displacement of the second wedge element 262.

The bridge element 252 is connected to the first wedge element 254 and is articulated thereto for pivotal movement about a fourth pivot axis 266 via a corresponding pivot bearing 264. The third pivot axis 250 and the fourth pivot axis 266 are parallel to the first pivot axis 230.

The bridge element 252 has associated with it an adjustment device 268 corresponding to the adjustment device 92.

The second wedge element 262 is supported on the handle element 222 via a spring device 270.

The mechanism of the toggle clamp 200 corresponds to the mechanism of the toggle clamp 10 as described above. A workpiece can be clamped between the contact element 238 and a corresponding support (which then has the base 202 fixed thereto). The clamping force (the toggle lever force) can be adjusted via the adjustment device 268.

In the toggle clamp 200, provision is made for a handle element 222 which is spaced from the underside 204 of the base. The handle 244 and the stationary handle element 222 can be grasped together by one hand of the operator. By pressing the handle 244 downwardly in a direction towards the handle element 222, the contact element 238 is moved in a direction towards the support in order to clamp a workpiece. The toggle clamp 200 is then a horizontal clamp.

By the spacing of the handle element 222 from the underside 204, an operator can reach through between a support, which has the base 202 fixed thereto, and the handle element 222 and thus grasp the handle element 222 along with the handle 244.

Otherwise, the toggle clamp 200 works like the toggle clamp 10.

Figure 23:
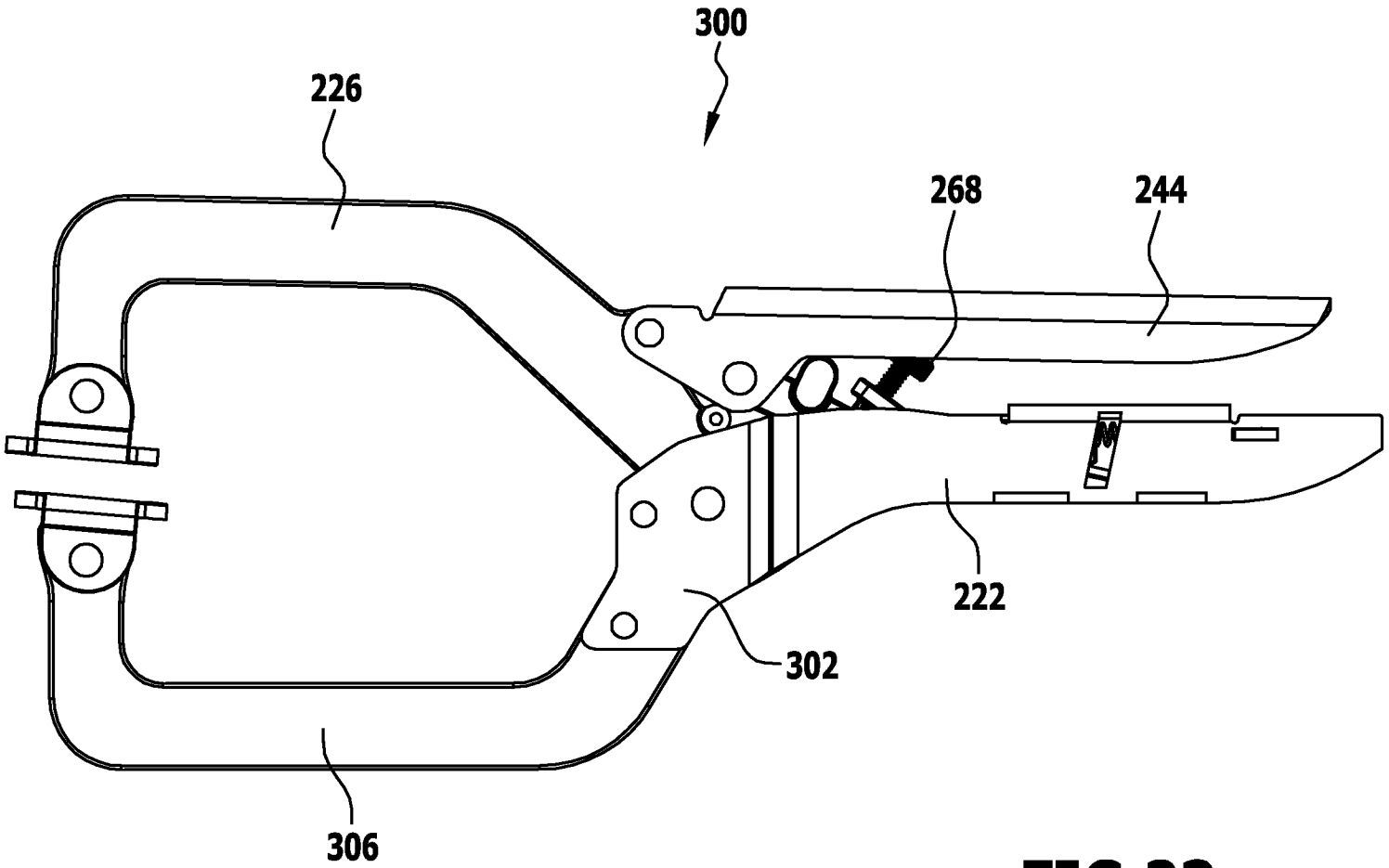
Figure 24:
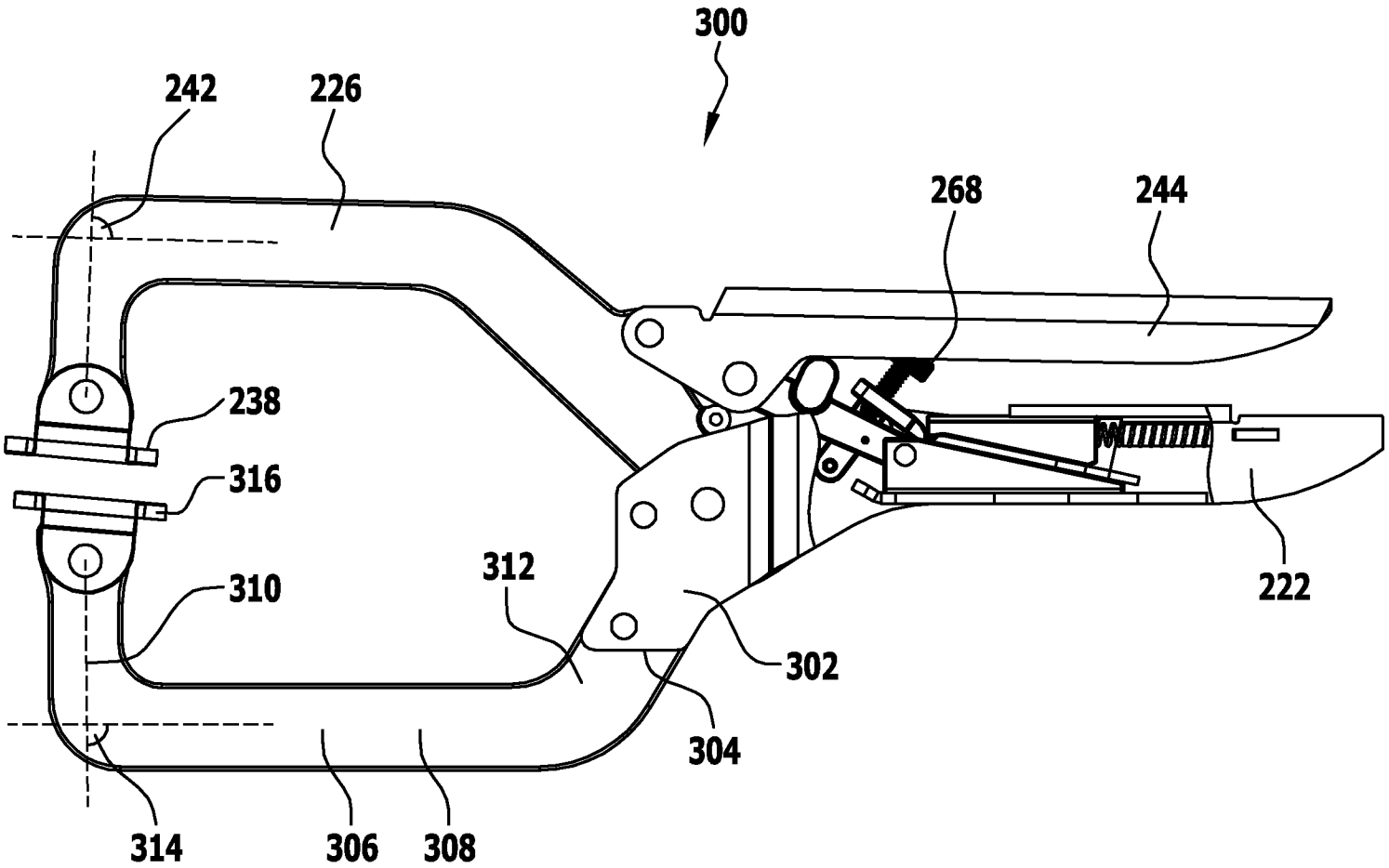

A fifth exemplary embodiment of a clamping tool constructed in accordance with the invention, shown in FIGS. 23 and 24 and indicated therein by 300, is a toggle clamp in the form of pliers or locking pliers. The locking pliers 300 are of similar configuration as the clamping tool 200. Like reference characters are used for like elements.

The locking pliers 300 comprise a base 302 on which is located the handle element 222 including the corresponding mechanism. Articulated to the base 302 is, correspondingly, the first clamping arm 226 together with its contact element 238. Pivotally located on the clamping arm 226 is the handle 244, as described above.

The mechanism for providing the toggle lever force and for adjusting the clamping force (toggle lever force) is the same as described above.

Located on the base 302, extending beyond the underside 304 thereof, is a second clamping arm 306. The second clamping arm 306 cooperates with the first clamping arm 226. It has a first region (middle region) 308 which has arranged thereon a second region 310 extending towards the one side and a third region 312 extending towards the other side. In particular, the first region, the second region and the third region are connected together in one piece. The second clamping arm 306 is rigidly connected to the base 302 via the third region 312.

The second region 310 is located in an angled relationship to the first region 308. An angle 314 is adapted to the angle 242 for the first clamping arm 226. In particular, the angle 314 is a right angle.

In a starting position in which the first region 232 of the first clamping arm 226 and the first region 308 of the second clamping arm 306 are oriented at least approximately parallel to each other and in which the handle 244 is pivoted towards the handle element 222, the second region 310 of the second clamping arm 306 and the second region 234 of the first clamping arm 226 are aligned at least approximately in line with each other.

Pivotally located on the second region 310 of the second clamping arm 306 is a contact element 316 for a workpiece. A workpiece is capable of being clamped between the first clamping arm 226 and the second clamping arm 306, in contacting relationship against the respective contact elements 238 and 316.

The clamping tool 300 is configured in the form of pliers and is configured in particular in the form of locking pliers. In the open position of the clamping arms 226, 306, in which position the handle 244 is pivoted away from the handle element 222 (this would correspond to the position shown in FIG. 1), a jaw between the contact elements 238 and 316 is open. Pivoting the handle 244 in a direction towards the handle element 222 allows a workpiece to be clamped between the first clamping arm 226 and the second clamping arm 306 and then for example to be transported.

An operator can grasp the handle 244 and the handle element 222 in one hand.

The locking pliers 300 have a toggle lever. The toggle lever force is adjustable via the adjustment device 268 analogously to what has been described above for the case of the toggle clamp 10.

The mechanism corresponds to the mechanism as described in connection with the toggle clamps 200 and 10.

LIST OF REFERENCE CHARACTERS

10 toggle clamp (first exemplary embodiment)
12 base
14 support
16 first joint
18 first pivot axis
20 clamping arm
22 first region
24 second region
26 end
28 contact element
30 holding ball
32 receptacle
34 holding pin
36 second joint
38 second pivot axis
40 handle
42 first region
44 second region
46 angle
48 grip element
52 contact region
54 third joint
56 third pivot axis
57 bridge element
58 guide
60 first wedge element
62 direction of displacement
64 guide surface
66 underside
68 first wedge surface
70 fourth joint
72 fourth pivot axis
74 second wedge element
75 intermediate element
76 direction of displacement
78 guide
80 second wedge surface
82 upper side
84 wall
86 spring device
88 rear wall
90 direction of force
92 adjustment device
94 operative element
96 contact surface
98 holder
100 fifth joint
102 fifth pivot axis
104 adjusting element
106 region
108 double-headed arrow
110 direction of motion
112 air gap
114 angle
116 direction of longitudinal extent
120 toggle clamp (second exemplary embodiment)
122 base
124 first joint
126 clamping arm
128 second joint
130 handle
132 guide
134 first wedge element
136 second wedge element
137 intermediate element
138 bridge element
140 third joint
142 fourth joint
144 spring device
146 recess
148 direction
150 grip element
152 angle
160 toggle clamp (third exemplary embodiment)
162 base
164 first joint
166 first pivot axis
167 clamping arm
168 second joint
170 second pivot axis
172 handle
174 third joint
176 third pivot axis
178 bridge element
180 guide
182 first wedge element
183 intermediate element
184 fourth joint
186 fourth pivot axis
188 second wedge element
190 direction
192 angle
194 spring device
196 rear wall
200 toggle clamp (fourth exemplary embodiment)
202 base
204 underside
206 pin
208 head
210 slot
212 plate
214 fastening element
216 first region
218 second region
220 groove
222 handle element
224 direction of longitudinal extent
226 (first) clamping arm
228 pivot bearing
230 first pivot axis
232 first region
234 second region
236 third region
238 contact element
240 pivot axis
242 angle
244 handle
246 pivot bearing
248 second pivot axis
250 third pivot axis
252 bridge element

254 first wedge element
256 guide
258 first wedge surface
260 second wedge surface
262 second wedge element
264 pivot bearing
266 fourth pivot axis
268 adjustment device
270 spring device
300 locking pliers (fifth exemplary embodiment)
302 base
304 underside
306 second clamping arm
308 first region
310 second region
312 third region
314 angle
316 contact element.

The invention claimed is:

1. Clamping tool, comprising:
a base;
a clamping arm articulated to the base for pivotal movement about a first pivot axis;
a handle articulated to the clamping arm or the base for pivotal movement about a second pivot axis;
a bridge element articulated to the handle or the clamping arm for pivotal movement about a third pivot axis;
a first wedge element having a first wedge surface, said first wedge element being linearly guided on a guide; and
a second wedge element having a second wedge surface facing towards the first wedge surface, said second wedge element being adapted to the first wedge element and being linearly guided;
wherein:
in a first positional range of the handle, the first wedge surface and the second wedge surface are spaced apart from one another;
in a second positional range of the handle, the second wedge surface is supported on the first wedge surface and a displacement of the first wedge element drives a displacement of the second wedge element;
the bridge element is connected to the first wedge element and is articulated to the first wedge element for pivotal movement about a fourth pivot axis;
an adjustment device is provided which acts on the second wedge element and which provides a capability of adjusting a position of the second wedge element in which the first wedge element acts on the second wedge element for driving the second wedge element;
the adjustment device is arranged on the bridge element; and
the adjustment device comprises an operative element pivotally connected to the bridge element via a joint for pivotal movement about a fifth pivot axis.

2. Clamping tool in accordance with claim 1, wherein the bridge element is of a rigid configuration.

3. Clamping tool in accordance with claim 1, wherein the bridge element is of a rigid configuration between a further joint for articulation to the handle or to the clamping arm and an additional further joint for articulation to the first wedge element.

4. Clamping tool in accordance with claim 1, wherein the first pivot axis, the second pivot axis, the third pivot axis and the fourth pivot axis are oriented parallel to one another.

5. Clamping tool in accordance with claim 1, wherein the fifth pivot axis is parallel to the fourth pivot axis.

6. Clamping tool in accordance with claim 1, wherein the operative element has located thereon an adjustment element by which an angular position of the operative element relative to the bridge element is fixably adjustable.

7. Clamping tool in accordance with claim 6, wherein the adjustment element is a screw which is guided in a thread on the operative element.

8. Clamping tool in accordance with claim 1, wherein the operative element is supported on the first wedge element in at least a portion of a range of pivotal motion of the operative element.

9. Clamping tool in accordance with claim 1, wherein the operative element is of rounded configuration in an area capable of acting on the second wedge element.

10. Clamping tool in accordance with claim 1, wherein:
a spring device is provided which acts on the second wedge element,
a spring force of the spring device tends to urge the second wedge element in a direction towards the bridge element.

11. Clamping tool in accordance with claim 1, wherein the guide is arranged on the base.

12. Clamping tool in accordance with claim 11, wherein:
the base has an underside which faces away from the clamping arm, and
the guide is spaced at a height distance from the underside of the base.

13. Clamping tool in accordance with claim 12, wherein the clamping tool is fixable to an application via the underside of the base.

14. Clamping tool in accordance with claim 1, wherein the base has a handle element arranged thereon.

15. Clamping tool in accordance with claim 14, wherein the handle element is rigidly connected to the base.

16. Clamping tool in accordance with claim 15, wherein in a starting position of the clamping tool, the handle and the handle element are oriented at least approximately parallel to one another.

17. Clamping tool in accordance with claim 14, wherein the guide is arranged on the handle element.

18. Clamping tool in accordance with claim 14, wherein the first wedge element and the second wedge element are arranged on the handle element.

19. Clamping tool in accordance with claim 14, wherein the handle element of the base and the handle are arranged oppositely to each other and are graspable in common by a hand of an operator.

20. Clamping tool in accordance with claim 1, wherein:
the clamping arm is a first clamping arm and the base has arranged thereon a second clamping arm,
a workpiece is clampable between the first clamping arm and the second clamping arm.

21. Clamping tool in accordance with claim 20, wherein the second clamping arm is fixably connected to the base.

22. Clamping tool in accordance with claim 20, wherein the clamping tool is configured as at least one of pliers and locking pliers.

23. Clamping tool in accordance with claim 1, wherein:
at least one of the clamping arm and a further clamping arm has a first region, said first region having located thereon an angled second region,
the second region has arranged thereon a contact element for a workpiece.

24. Clamping tool in accordance with claim 23, wherein the contact element is pivotally or rotatably located on the second region.

25. Clamping tool in accordance with claim 23, wherein the second region is oriented in an angular range between 70° and 110° relative to the first region.

26. Clamping tool in accordance with claim 23, wherein the clamping arm and the further clamping arm are present, the second region of the clamping arm and the second region of the further clamping arm are aligned at least approximately in line with each other when the clamping arm is in a starting position.

27. Clamping tool in accordance with claim 1, wherein clamping of a workpiece by the clamping arm is effectable by pivoting the handle in a direction towards the base.

28. Clamping tool in accordance with claim 1, wherein:
the clamping arm is articulated to the base,
the handle is articulated to the clamping arm, and
the bridge element is articulated to the handle.

29. Clamping tool in accordance with claim 28, wherein the bridge element is oriented at least approximately parallel to the clamping arm when at a toggle lever dead center.

* * * * *